US011001985B2

(12) United States Patent
Ito et al.

(10) Patent No.: US 11,001,985 B2
(45) Date of Patent: May 11, 2021

(54) WORK MACHINE

(71) Applicant: HITACHI CONSTRUCTION MACHINERY CO., LTD., Tokyo (JP)

(72) Inventors: Masamichi Ito, Ushiku (JP); Hisami Nakano, Tsuchiura (JP); Yusuke Suzuki, Tsuchiura (JP); Akihiro Narazaki, Tsukuba (JP); Teruki Igarashi, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 263 days.

(21) Appl. No.: 16/328,398

(22) PCT Filed: Sep. 13, 2017

(86) PCT No.: PCT/JP2017/033077
§ 371 (c)(1),
(2) Date: Feb. 26, 2019

(87) PCT Pub. No.: WO2019/053814
PCT Pub. Date: Mar. 21, 2019

(65) Prior Publication Data
US 2020/0157768 A1 May 21, 2020

(51) Int. Cl.
*E02F 3/43* (2006.01)
*E02F 9/20* (2006.01)
(Continued)

(52) U.S. Cl.
CPC ..... *E02F 3/435* (2013.01); *E02F 9/2004* (2013.01); *E02F 9/2033* (2013.01);
(Continued)

(58) Field of Classification Search
CPC . E02F 3/435; E02F 3/32; E02F 9/2004; E02F 9/2033; E02F 9/2203; E02F 9/2271; E02F 9/26; E02F 9/2207; E02F 9/2025
See application file for complete search history.

(56) References Cited

U.S. PATENT DOCUMENTS 5,768,810 A * 6/1998 Ahn ..... E02F 3/436 37/348
7,530,225 B2 * 5/2009 Ikeda ..... E02F 3/43 60/421
(Continued)

FOREIGN PATENT DOCUMENTS

JP 02-176023 A 7/1990
JP 09-273502 A 10/1997
JP 5865510 B2 2/2016

OTHER PUBLICATIONS

International Preliminary Report on Patentability received in corresponding International Application No. PCT/JP2017/033077 dated Mar. 26, 2020.
(Continued)

*Primary Examiner* — Michael J Zanelli
(74) *Attorney, Agent, or Firm* — Mattingly & Malur, PC

(57) ABSTRACT

A controller for a hydraulic excavator includes a first speed computation section that calculates a first speed of an arm cylinder from a value detected by an operation amount sensor; a second speed computation section that calculates a second speed from a value detected by a posture sensor and a third speed computation section calculates a third speed that is used as the speed of the arm cylinder in an actuator control section adapted to execute MC (machine control). The third speed computation section calculates the first speed as the third speed during the period between the detection of an input of operation for an arm by the operation amount sensor and predetermined time to, the third speed as
(Continued)

a speed calculated from the first speed and the second speed during the period between t0 and time t1, and the second speed as the third speed at and after time t1.

5 Claims, 18 Drawing Sheets

(51) Int. Cl.
*E02F 9/22* (2006.01)
*E02F 9/26* (2006.01)
*E02F 3/32* (2006.01)

(52) U.S. Cl.
CPC ..... *E02F 9/2203* (2013.01); *E02F 9/2271* (2013.01); *E02F 9/26* (2013.01); *E02F 3/32* (2013.01)

(56) References Cited

U.S. PATENT DOCUMENTS

| | | | | |
|---|---|---|---|---|
| 10,156,061 | B2 * | 12/2018 | Matsuyama ..... | E02F 9/2207 |
| 10,801,187 | B2 * | 10/2020 | Izumi ..... | E02F 9/2271 |
| 2016/0069044 | A1 | 3/2016 | Takaura et al. | |

OTHER PUBLICATIONS

International Search Report of PCT/JP2017/033077 dated Dec. 5, 2017.

* cited by examiner

WORK MACHINE

TECHNICAL FIELD

The present invention relates to a work machine that controls at least one of a plurality of hydraulic actuators under predetermined conditions when an operation device is operated.

BACKGROUND ART

Machine control (MC) is a technology that improves the work efficiency of a work machine (e.g., a hydraulic excavator) having a work device (e.g., a front work device) driven by a hydraulic actuator. The MC is a technology that provides operational assistance to an operator by executing semi-automatic control for operating the work device under predetermined conditions when an operation device is operated by the operator.

A technology disclosed, for example, in Japanese Patent No. 5865510 provides MC of the front work device in such a manner as to move the blade edge of a bucket along a reference plane. According to this patent document, when the operation amount of an arm operation lever is small, the actual arm cylinder speed may be higher than an estimated arm cylinder speed calculated based on the operation amount of the arm operation lever due to the free fall of the bucket depending on the posture of the front work device. If MC is executed based on the estimated arm cylinder speed under such circumstances, the blade edge of the bucket may become unstable to cause hunting. When the operation amount of the arm operation lever is smaller than a predetermined amount, the technology described in this patent document performs calculations to determine a speed higher than the speed calculated based on the operation amount of the arm operation lever as the estimated arm cylinder speed that takes into account the free fall of the bucket, and executes MC based on such an estimated arm cylinder speed in order to solve the above-mentioned problem.

PRIOR ART DOCUMENT

Patent Document

Patent Document 1: Japanese Patent No. 5865510

SUMMARY OF THE INVENTION

Problem to be Solved by the Invention

When the free fall of the bucket is taken into account during the calculation of the estimated arm cylinder speed as described with reference to the technology disclosed in Patent Document 1, the calculated estimated arm cylinder speed is close to the actual arm cylinder speed. Therefore, hunting can be avoided during MC. However, the deviation of the arm cylinder speed estimated based on the operation amount of the arm operation lever from the actual arm cylinder speed is not only due to the free fall of the bucket. Consequently, the occurrence of hunting is not sufficiently avoided by estimating the arm cylinder speed in consideration of the free fall of the bucket as described in Patent Document 1.

For example, the viscosity of a hydraulic operating fluid for the work machine is high at a low temperature. In this instance, however, the actual arm cylinder speed may be lower than the speed estimated from a lever operation amount.

Further, when a raking-and-leveling operation is to be performed, that is, when earth on a sloped surface below the work machine is to be raked and leveled as illustrated, for example, in FIG. 13, an arm cylinder is driven in the direction of lifting the front work device (e.g., a bucket) against its own weight. Therefore, the arm cylinder speed is rarely higher than expected under the influence of the own weight of the front work device (an arm or a bucket) concerning the drive of the arm cylinder as indicated in Patent Document 1. In some cases, the actual arm cylinder speed may be rather lower than the estimated speed due to driving in the direction of lifting the own weight of the front work device. These cases are described in detail below.

FIG. 14 illustrates the opening area characteristics of a spool of an open center bypass type in a hydraulic system used for a work machine. The opening area of the open center bypass spool includes a center bypass opening of a flow line for flowing a hydraulic fluid from a pump to a tank, a meter-in opening of a flow line for supplying the hydraulic fluid from the pump to an actuator, and a meter-out opening of a flow line for flowing the hydraulic fluid from the actuator to the tank. It is assumed that a closed-off point for the center bypass opening is SX. The flow of hydraulic fluid in a case where the arm cylinder is driven in the direction of lifting the front work device against its own weight as in the raking-and-leveling operation will now be described. As the arm cylinder is driven in the direction of lifting the front work device against its own weight during the raking-and-leveling operation, the pressure on the meter-in side is increased by the own weight of the front work device. When the operation amount of the arm operation lever is small and the amount of spool stroke is smaller than SX, the center bypass opening is open. Therefore, the hydraulic fluid supplied from the pump is divided into a hydraulic fluid to be supplied to the arm cylinder through the meter-in opening and a hydraulic fluid to be supplied to the tank through the center bypass opening. The hydraulic fluid is likely to flow in a direction toward light load. Consequently, when the arm cylinder is driven in the direction of lifting the front work device against its own weight, the load on the arm cylinder is higher than when the arm cylinder is not driven in the direction of lifting the front work device against its own weight. As a result, the hydraulic fluid does not easily flow to the arm cylinder. This decreases the arm cylinder speed.

As described above, the actual arm cylinder speed differs in some cases from the speed estimated from the lever operation amount depending on the state of the work machine and on its operation. As a result, the blade edge of the bucket (the end of the work device) is unstable during MC. This may cause hunting.

Meanwhile, the work machine designed to provide MC in the above-described manner includes a posture sensor (e.g., a potentiometer attached to a pin for coupling the arm to a boom) that detects the posture of the work device. The arm cylinder speed computed from the lever operation amount is nothing more than an estimated value. However, an output generated from the posture sensor makes it possible to grasp the actual posture of the work device. The arm cylinder speed calculated from temporal changes in the output value of the posture sensor is usually closer to the actual speed than the speed calculated from the lever operation amount. In view of these circumstances, it is conceivable that MC can be provided based on the arm cylinder speed calculated from the output value of the posture sensor. However, there is still the following problem with such use of the posture sensor.

The posture sensor is not able to detect changes in the posture of the arm until the arm actually starts moving. Therefore, if MC based on the arm speed calculated from the output value of the posture sensor is executed when the arm starts moving, the response (e.g., a boom raising command) of MC to the beginning of actual arm movement may be delayed. Consequently, the blade edge position of the bucket may become unstable to cause hunting.

The problem has been described by citing the arm cylinder speed as an example. However, the same problem applies to the speed of the other hydraulic actuators that drive the work device.

An object of the present invention is to provide a work machine that calculates more appropriately the speed of a specific hydraulic actuator for driving a work device and stabilizes the behavior of the tip of the work device (e.g., the blade edge of a bucket) during MC.

Means for Solving the Problem

The present application includes a plurality of means for solving the above-described problem. As an example, there is provided a work machine having a work device, a plurality of hydraulic actuators, an operation device, and a controller. The work device includes a plurality of front members. The plurality of hydraulic actuators drive the plurality of front members. The operation device instructs each of the plurality of hydraulic actuators on an operation thereof in accordance with an operation of an operator. The controller includes an actuator control section that controls at least one of the plurality of hydraulic actuators in accordance with speeds of the plurality of hydraulic actuators and with predetermined conditions when the operation device is operated. The work machine includes a posture sensor and an operation amount sensor. The posture sensor detects a physical quantity concerning a posture of a specific front member that is one of the plurality of front members. The operation amount sensor detects a physical quantity concerning an operation amount for the specific front member that is among operation amounts inputted to the operation device by the operator. The controller includes a first speed computation section, a second speed computation section, and a third speed computation section. The first speed computation section calculates, from a value detected by the operation amount sensor, a first speed of a specific hydraulic actuator for driving the specific front member. The specific hydraulic actuator is among the plurality of hydraulic actuators. The second speed computation section calculates a second speed of the specific hydraulic actuator from a value detected by the posture sensor. The third speed computation section calculates, in accordance with the first speed and with the second speed, a third speed that is used as a speed of the specific hydraulic actuator by the actuator control section. The third speed computation section calculates the first speed as the third speed during a period between a detection of an input of operation for the specific front member by the operation amount sensor and a first predetermined time, calculates as the third speed a speed calculated from the first speed and the second speed during a period between the first predetermined time and a second predetermined time that is later than the first predetermined time, and calculates the second speed as the third speed at and after the second predetermined time.

Advantages of the Invention

The present invention makes it possible to calculate more appropriately the speed of a specific hydraulic actuator for driving a work device and stabilize the behavior of the tip of the work device during MC.

MODES FOR CARRYING OUT THE INVENTION

Figure 1:
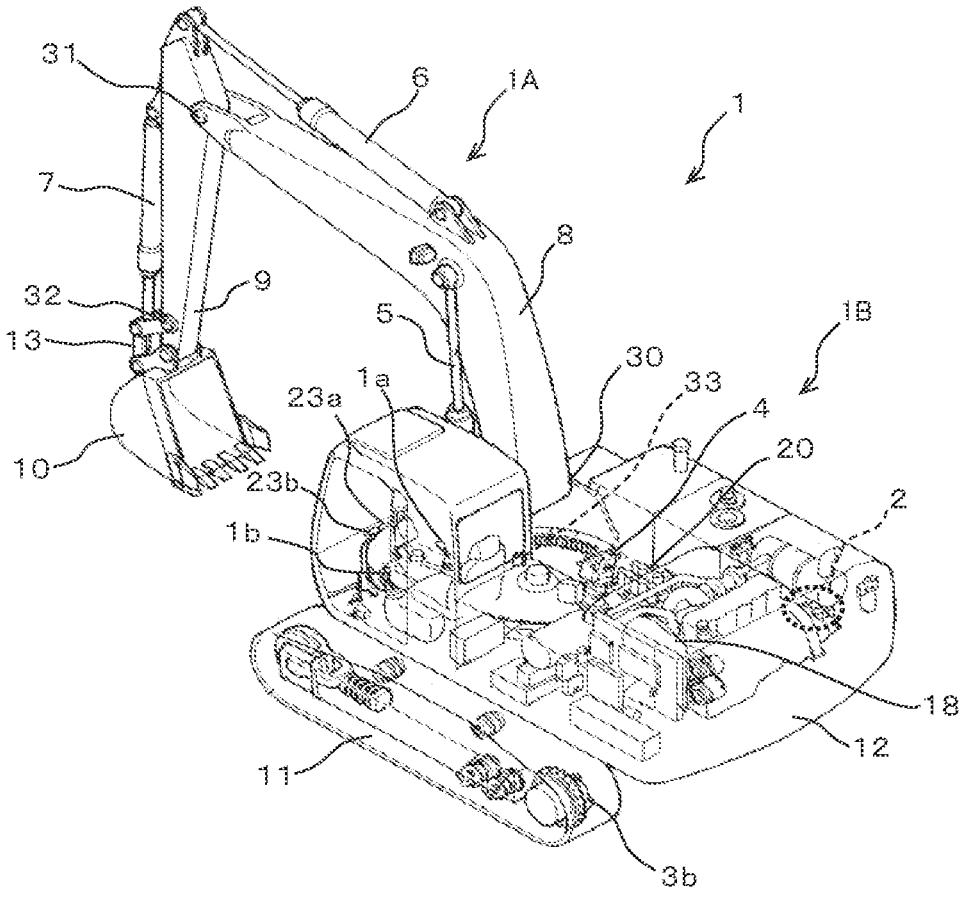
FIG. 1 is a diagram illustrating a structure of a hydraulic excavator.

Embodiments of the present invention will now be described with reference to the accompanying drawings. Exemplified in the following description is a hydraulic excavator having a bucket 10 as a work tool (an attachment) on the tip of a work device. However, the present invention may be applied to a work machine having an attachment other than a bucket. Further, the present invention is also applicable to a work machine other than a hydraulic excavator as far as the work machine includes a multi-joint work device that is formed by coupling a plurality of front members (an attachment, an arm, a boom, etc.).

Meanwhile, this document uses "on," "above," or "below" together with a term indicative of a certain shape (e.g., a target surface or a design surface). The word "on" indicates the "surface" of such a certain shape, the word "above" indicates a "position higher than the surface" of such a certain shape, and the word "below" indicates a "position lower than the surface" of such a certain shape. Further, in the following description, a plurality of identical elements may be designated by reference characters (signs or numerals) suffixed with an alphabetical letter. In some cases, however, the plurality of identical elements may be designated collectively without using such an alphabetical letter. For example, when two pumps 2*a* and 2*b* exist, they may be designated as the pumps 2.

Embodiment 1

<Basic Structure>

Figure 2:
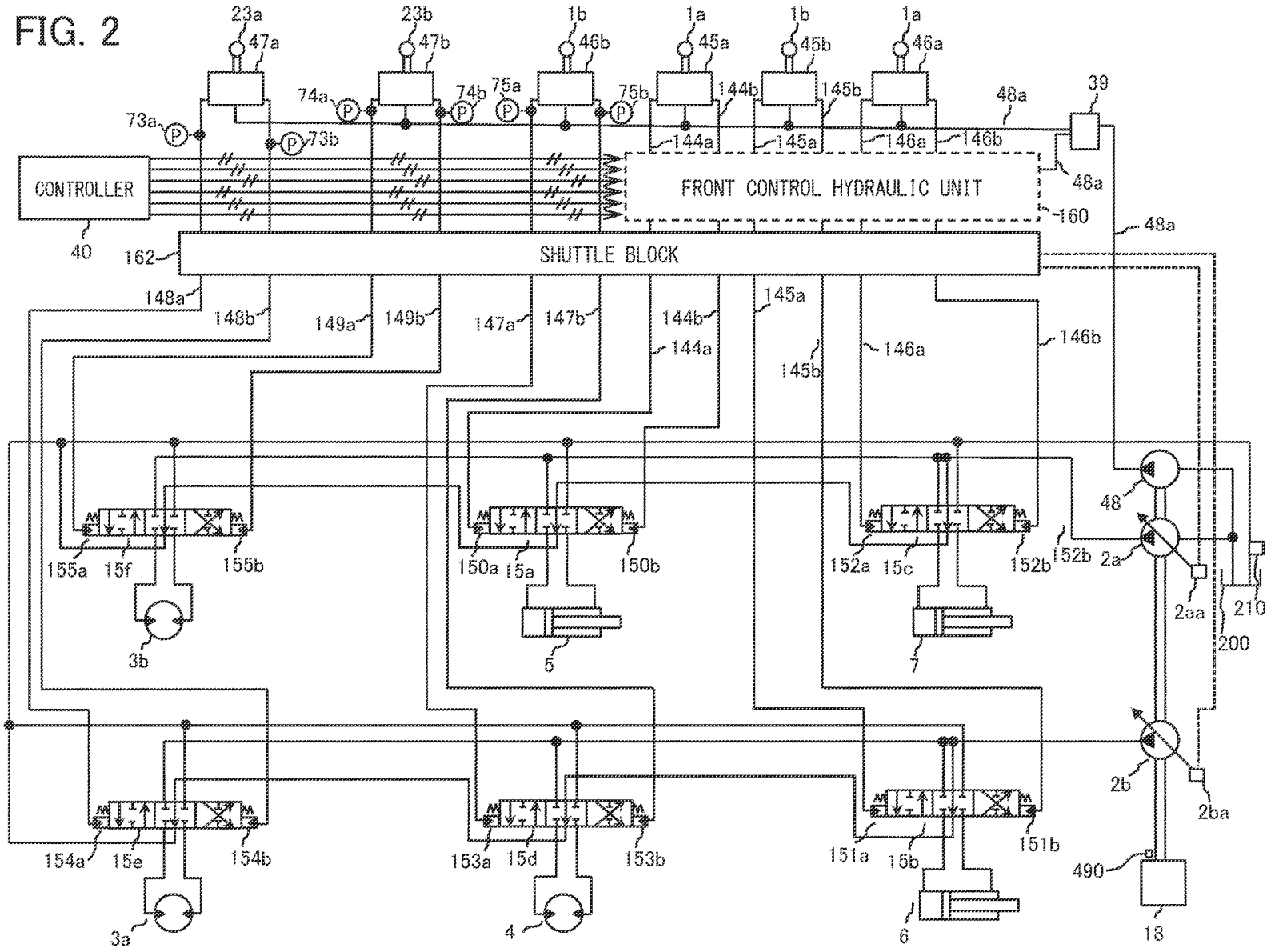
FIG. 2 is a diagram illustrating a controller for the hydraulic excavator together with a hydraulic drive system.
Figure 3:
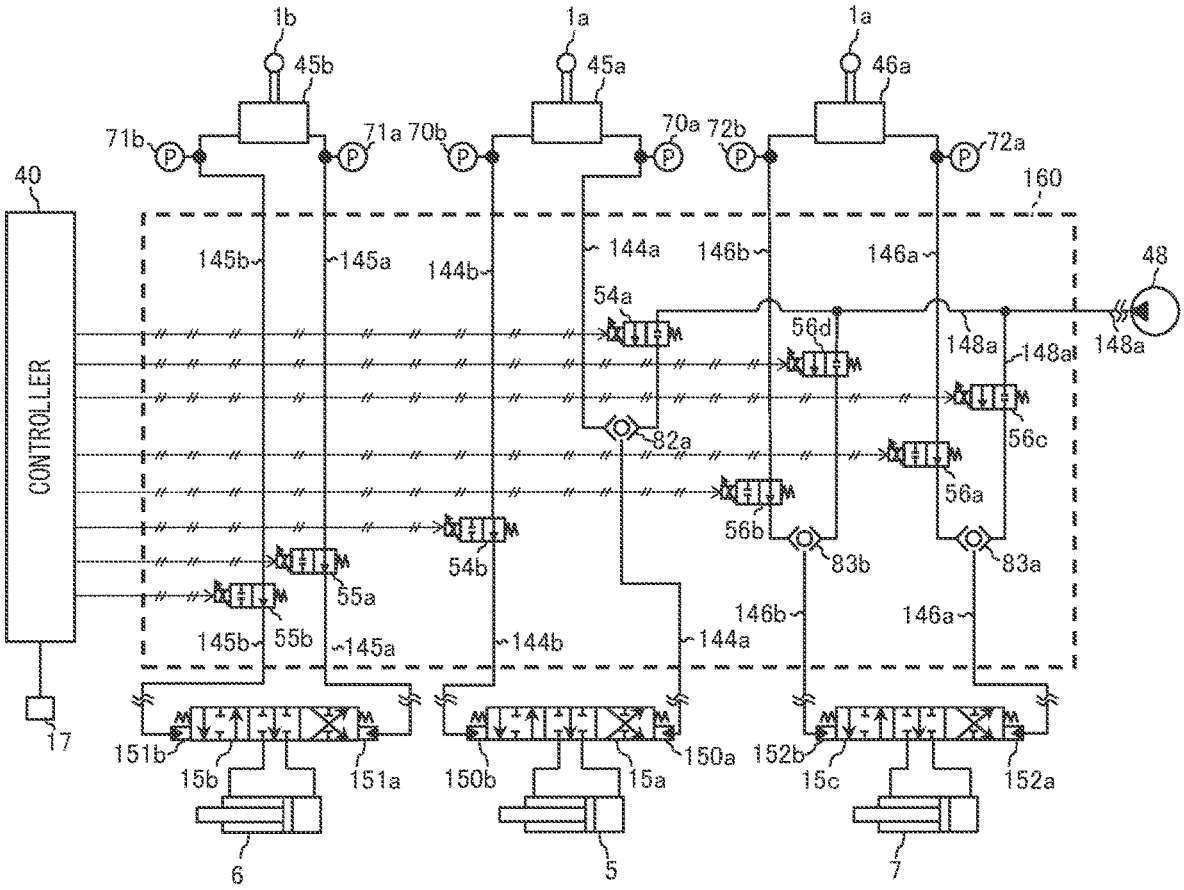
FIG. 3 is a diagram illustrating the details of a front control hydraulic unit.

FIG. 1 is a diagram illustrating a structure of a hydraulic excavator according to Embodiment 1 of the present invention. FIG. 2 is a diagram illustrating a controller for the hydraulic excavator according to embodiments of the present invention together with a hydraulic drive system. FIG. 3 is a diagram illustrating the details of a front control hydraulic unit 160.

Referring to FIG. 1, the hydraulic excavator 1 includes a multi-joint front work device 1A and a machine body 1B. The machine body 1B includes a lower travel structure 11 and an upper swing structure 12. Left and right travel hydraulic motors 3*a* (see FIG. 2), 3*b* cause the lower travel structure 11 to travel. A swing hydraulic motor 4 swings the upper swing structure 12, which is mounted on the lower travel structure 11.

The front work device 1A is formed by coupling a plurality of front members (a boom 8, an arm 9, and a bucket 10), which respectively pivot in the vertical direction. The base end of the boom 8 is pivotally supported through a boom pin at the front of the upper swing structure 12. The arm 9 is pivotally coupled to the tip of the boom 8 through an arm pin. The bucket 10 is pivotally coupled to the tip of the arm 9 through a bucket pin. The plurality of front members 8, 9, and 10 are driven by a plurality of hydraulic cylinders 5, 6, and 7, which are hydraulic actuators. More specifically, the boom 8 is driven by a boom cylinder 5, the arm 9 is driven by an arm cylinder 6, and the bucket 10 is driven by a bucket cylinder 7.

In such a manner as to be able to measure pivot angles $\alpha$, $\beta$, and $\gamma$ (see FIG. 5), which are physical quantities concerning the postures of the boom 8, arm 9, and bucket 10, a boom angle sensor 30 is attached to the boom pin, an arm angle sensor 31 is attached to the arm pin, and a bucket angle sensor 32 is attached to a bucket link 13. In addition, a machine body inclination angle sensor 33 is attached to the upper swing structure 12 in order to detect the inclination angle $\theta$ (see FIG. 5) of the upper swing structure 12 (machine body 1B) with respect to a reference plane (e.g., horizontal plane). Meanwhile, the angle sensors 30, 31, and 32 according to the present embodiment are rotary potentiometers. However, each of them may be substituted, for example, by a sensor for measuring the inclination angle with respect to the reference plane (e.g., horizontal plane) or by an inertial measurement unit (IMU).

Installed in a cab mounted on the upper swing structure 12 are an operation device 47*a* (FIG. 2), an operation device 47*b* (FIG. 2), operation devices 45*a* and 46*a* (FIG. 2), and operation devices 45*b* and 46*b* (FIG. 2). The operation device 47*a* includes a travel right lever 23*a* (FIG. 1) and operates a travel right hydraulic motor 3*a* (lower travel structure 11). The operation device 47*b* includes a travel left lever 23*b* (FIG. 1) and operates a travel left hydraulic motor 3*b* (lower travel structure 11). The operation devices 45*a* and 46*a* share an operation right lever 1*a* (FIG. 1) and operate the boom cylinder 5 (boom 8) and the bucket cylinder 7 (bucket 10). The operation devices 45*b* and 46*b* (FIG. 2) share an operation left lever 1*b* (FIG. 1) and operate the arm cylinder 6 (arm 9) and the swing hydraulic motor 4 (upper swing structure 12). The travel right lever 23*a*, the travel left lever 23*b*, the operation right lever 1*a*, and the operation left lever 1*b* may be hereinafter generically referred to as the operation levers 1 and 23.

An engine 18 mounted in the upper swing structure 12 acts as a prime mover and drives hydraulic pumps 2*a* and 2*b* and a pilot pump 48. The hydraulic pumps 2*a* and 2*b* are variable displacement pumps, and their displacements are controlled by regulators 2*aa* and 2*ba*. The pilot pump 48 is a fixed displacement pump. The hydraulic pumps 2 and the pilot pump 48 draw a hydraulic fluid from a tank 200. In the present embodiment, as illustrated in FIG. 2, a shuttle block 162 is disposed in the middle of pilot lines 144, 145, 146, 147, 148, and 149. Hydraulic signals outputted from the operation devices 45, 46, and 47 are additionally inputted to the regulators 2*aa* and 2*ba* through the shuttle block 162. Although the detailed structure of the shuttle block 162 is not described here, the hydraulic signals are inputted to the regulators 2*aa*, 2*ba* through the shuttle block 162 so as to control the delivery flow rates of the hydraulic pumps 2*a* and 2*b* in accordance with the hydraulic signals.

A pump line 48*a* is a delivery piping for the pilot pump 48. The pump line 48*a* runs through a lock valve 39, then branches into a plurality of lines, and connects to various valves in the operation devices 45, 46, and 47 and in the front control hydraulic unit 160. The lock valve 39 is a solenoid selector valve in the present embodiment, and its solenoid drive section is electrically connected to a position sensor of a gate lock lever (not illustrated) disposed in the cab (FIG. 1). The position of the gate lock lever is detected by the position sensor, and a signal based on the position of the gate lock lever is inputted from the position sensor to the lock valve 39. If the gate lock lever is in a lock position, the lock valve 39 closes to close the pump line 48*a*. If, by contrast, the gate lock lever is in an unlock position, the lock valve 39 opens to open the pump line 48*a*. That is to say, if the pump line 48*a* is closed, operations by the operation devices 45, 46, and 47 are invalidated to prohibit operations such as swinging and excavating.

The operation devices 45, 46, and 47 are of a hydraulic pilot type, and generates a pilot pressure (may be referred to also as the operating pressure) based on the hydraulic fluid delivered from the pilot pump 48 in accordance with the operation amount (e.g., lever stroke) and operation direction of the operation levers 1, 23 operated by the operator. The pilot pressure generated in the above manner is supplied to associated hydraulic drive sections 150*a* to 155*b* of flow control valves 15*a* to 15*f* (FIG. 2 or 3) through the pilot lines 144*a* to 149*b* (see FIG. 3), and used as a control signal for driving the flow control valves 15*a* to 15*f*.

The hydraulic fluid delivered from the hydraulic pumps 2 is supplied to the travel right hydraulic motor 3*a*, the travel left hydraulic motor 3*b*, the swing hydraulic motor 4, the boom cylinder 5, the arm cylinder 6, and the bucket cylinder 7 through the flow control valves 15*a*, 15*b*, 15*c*, 15*d*, 15*e*, and 15*f* (see FIG. 2). The supplied hydraulic fluid expands and contracts the boom cylinder 5, the arm cylinder 6, and the bucket cylinder 7, and pivots the boom 8, the arm 9, and the bucket 10. This varies the position and posture of the bucket 10. Further, the supplied hydraulic fluid rotates the swing hydraulic motor 4 and swings the upper swing structure 12 with respect to the lower travel structure 11. Moreover, the supplied hydraulic fluid rotates the travel right hydraulic motor 3*a* and the travel left hydraulic motor 3*b*. This causes the lower travel structure 11 to travel.

The tank 200 includes a hydraulic fluid temperature sensor 210 that detects the temperature of the hydraulic fluid for driving the hydraulic actuators. The hydraulic fluid temperature sensor 210 may be installed outside the tank 200. For example, the hydraulic fluid temperature sensor 210 may be attached to an inlet or outlet line for the tank 200.

Figure 4:
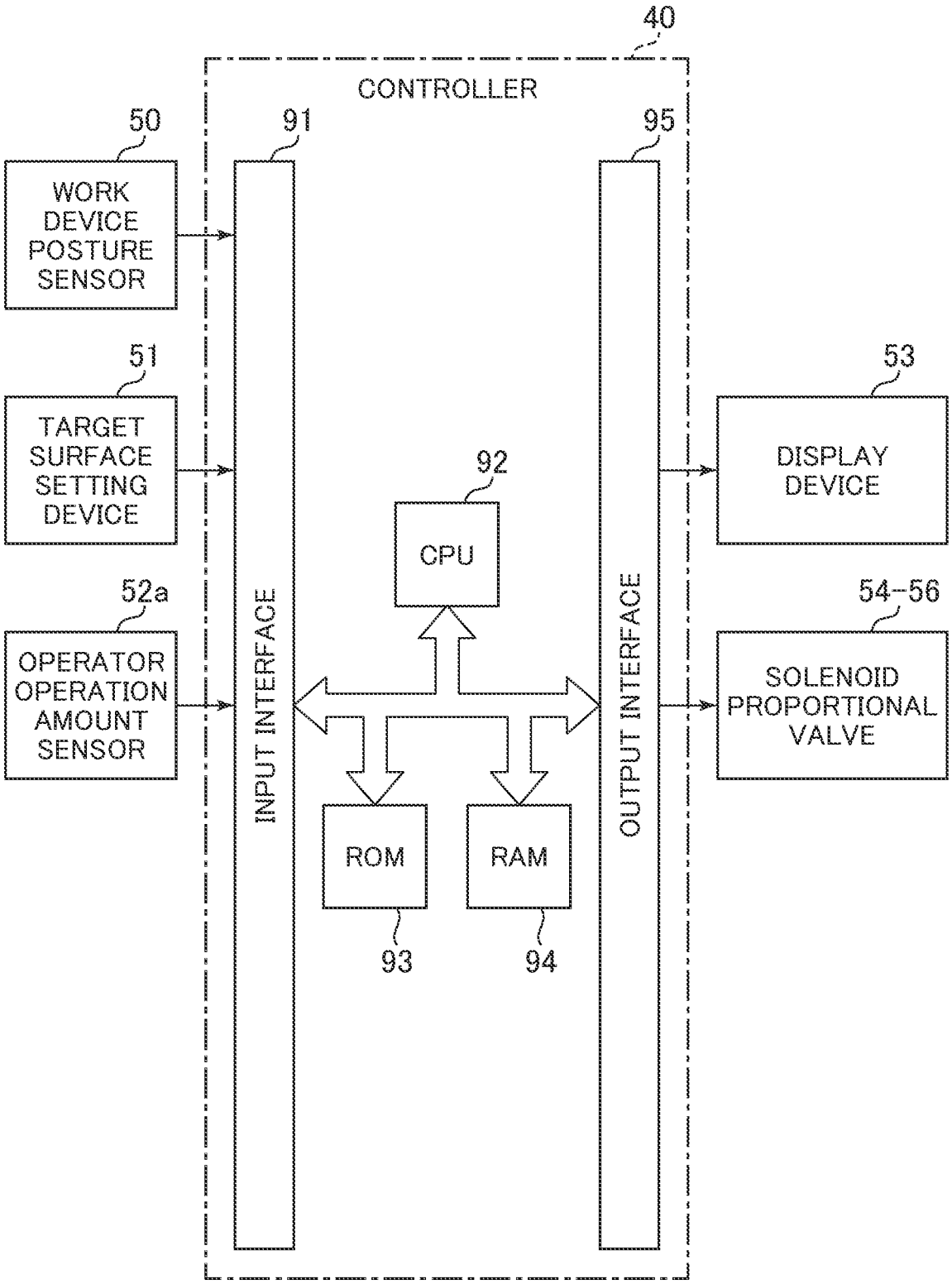
FIG. 4 is a diagram illustrating a hardware structure of the controller for the hydraulic excavator.

FIG. 4 is a diagram illustrating a structure of a machine control (MC) system included in the hydraulic excavator according to the present embodiment. When the operation devices 45 and 46 are operated by the operator, the system illustrated in FIG. 4 provides MC, that is, executes a process of controlling the speeds of the hydraulic cylinders 5, 6, and 7 and the front work device 1A under predetermined conditions. In this document, machine control (MC) may be referred to as "automatic control" in which the operation of the work device 1A is computer-controlled when the operation devices 45 and 46 are not operated, and may be referred to as "semi-automatic control" in which the operation of the work device 1A is computer-controlled when only the operation devices 45 and 46 are operated. MC according to the present embodiment will be described in detail below.

As MC of the front work device 1A, when an excavation operation (more specifically, an instruction for at least one of arm crowding, bucket crowding, and bucket dumping) is inputted through an operation device 45*b*, 46*a*, based on the positional relationship between a target surface 60 (see FIG. 5) and the tip of the front device 1A (the claw tip of the bucket 10 in the present embodiment), a control signal for forcing at least one of the hydraulic actuators 5, 6, and 7 to operate (e.g., for expanding the boom cylinder 5 to forcibly perform a boom raising operation) is outputted to an associated flow control valve 15*a*, 15*b*, 15*c* such that the position of the tip of the front device 1A is held on the target surface 60 and in a region above the target surface 60.

Executing MC in the above manner prevents the claw tip of the bucket 10 from intruding into a position below the target surface 60. Therefore, an excavation operation can be performed along the target surface 60 without regard to the skill of the operator. In the present embodiment, a control point for the front work device 1A during MC is set at the claw tip of the bucket 10 (at the tip of the work device 1A) of the hydraulic excavator. However, the control point may be set at a point other than the claw tip of the bucket as far as it is a point of the tip portion of the work device 1A. For example, the bottom surface of the bucket 10 or the outermost portion of the bucket link 13 is selectable as the control point.

The system illustrated in FIG. 4 includes a work device posture sensor 50, a target surface setting device 51, operator operation amount sensors 52*a*, a display device (e.g., liquid-crystal display) 53, and a controller 40. The display device 53 is installed in the cab and capable of displaying the positional relationship between the target surface 60 and the work device 1A. The controller 40 provides MC (master control).

The work device posture sensor (posture sensor) 50 includes the boom angle sensor 30, the arm angle sensor 31, the bucket angle sensor 32, and the machine body inclination angle sensor 33. These angle sensors 30, 31, 32, and 33 function as a posture sensor for detecting a physical quantity concerning the postures of a plurality of front members, namely, the boom 8, the arm 9, and the bucket 10.

The target surface setting device 51 is an interface that is capable of inputting information concerning the target surface 60 (information including the position information and inclination angle information about each target surface). The target surface setting device 51 is connected to an external terminal (not illustrated) that stores three-dimensional data concerning a target surface defined on a global coordinate system (absolute coordinate system). A target surface may be manually inputted by the operator through the target surface setting device 51.

The operator operation amount sensors (operation amount sensors) 52*a* include pressure sensors 70*a*, 70*b*, 71*a*, 71*b*, 72*a*, and 72*b*. The pressure sensors 70*a*, 70*b*, 71*a*, 71*b*, 72*a*, and 72*b* acquire an operating pressure (first control signal) that is generated in the pilot lines 144 and 145, and 146 when the operator operates the operation levers 1*a*, lb (operation devices 45*a*, 45*b*, and 46*a*). These pressure sensors 70*a*, 70*b*, 71*a*, 71*b*, 72*a*, and 72*b* function as an operation amount sensor for detecting a physical quantity concerning the amount of operation that is performed by the operator through the operation devices 45*a*, 45*b*, and 46*a* with respect to the boom 7 (boom cylinder 5), the arm 8 (arm cylinder 6), and the bucket 9 (bucket cylinder 7).

<Front Control Hydraulic Unit 160>

As illustrated in FIG. 3, the front control hydraulic unit 160 includes the pressure sensors 70*a* and 70*b*, a solenoid proportional valve 54*a*, a shuttle valve 82*a*, and a solenoid proportional valve 54*b*. The pressure sensors 70*a*, 70*b* are disposed in the pilot lines 144*a* and 144*b* of the operation device 45*a* for the boom 8, and detect a pilot pressure (first control signal) as the operation amount of the operation lever 1*a*. The solenoid proportional valve 54*a* has a primary port side connected to the pilot pump 48 through the pump line 148, reduces the pilot pressure from the pilot pump 48, and outputs the reduced pilot pressure. The shuttle valve 82*a* is connected to the pilot line 144*a* of the operation device 45*a* for the boom 8 and to the secondary port side of the solenoid proportional valve 54*a*, selects a higher pressure out of the pilot pressure in the pilot line 144*a* and a control pressure (second control signal) outputted from the solenoid proportional valve 54*a*, and directs the selected pressure to the hydraulic drive section 150*a* of the flow control valve 15*a*. The solenoid proportional valve 54*b* is installed in the pilot line 144*b* of the operation device 45*a* for the boom 8, reduces the pilot pressure (first control signal) in the pilot line 144*b* in accordance with a control signal from the controller 40, and outputs the reduced pilot pressure.

Further, the front control hydraulic unit 160 includes the pressure sensors 71*a* and 71*b*, a solenoid proportional valve 55*b*, and a solenoid proportional valve 55*a*. The pressure sensors 71*a* and 71*b* are installed in the pilot lines 145*a* and 145*b* for the arm 9, detect the pilot pressure (first control signal) as the operation amount of the operation lever 1*b*, and output the detected pilot pressure to the controller 40. The solenoid proportional valve 55*b* is installed in the pilot line 145*b*, reduces the pilot pressure (first control signal) in accordance with a control signal from the controller 40, and outputs the reduced pilot pressure. The solenoid proportional valve 55*a* is installed in the pilot line 145*a*, reduces the pilot pressure (first control signal) in the pilot line 145*a* in accordance with a control signal from the controller 40, and outputs the reduced pilot pressure.

Moreover, the front control hydraulic unit 160 is structured so that the pressure sensors 72*a* and 72*b*, solenoid proportional valves 56*a* and 56*b*, solenoid proportional valves 56*c* and 56*d*, and shuttle valves 83*a* and 83*b* are disposed in the pilot lines 146*a* and 146*b* for the bucket 10. The pressure sensors 72*a* and 72*b* detect the pilot pressure (first control signal) as the operation amount of the operation lever 1*a*, and output the detected pilot pressure to the controller 40. The solenoid proportional valves 56*a* and 56*b* reduce the pilot pressure (first control signal) in accordance with a control signal from the controller 40, and output the reduced pilot pressure. The solenoid proportional valves 56*c* and 56*d* has a primary port side connected to the pilot pump 48, reduces the pilot pressure from the pilot pump 48, and outputs the reduced pilot pressure. The shuttle valves 83*a* and 83*b* select a higher pressure out of the pilot pressure in the pilot lines 146*a* and 146*b* and a control pressure outputted from the solenoid proportional valve 56*c*, 56*d*, and direct the selected pressure to hydraulic drive sections 152*a*, 152*b* of the flow control valve 15*c*. Connection lines between the pressure sensors 70, 71, and 72 and the controller 40 are omitted from FIG. 3 due to space limitations.

The solenoid proportional valves 54*b*, 55*a*, 55*b*, 56*a*, and 56*b* maximize their openings when de-energized, and reduce their openings with an increase in a current acting as a control signal from the controller 40. Meanwhile, the solenoid proportional valves 54*a*, 56*c*, and 56*d* are closed when de-energized and open when energized. Their openings become larger with an increase in the current (control signal) from the controller 40. In this manner, the openings 54, 55, and 56 of the solenoid proportional valves are based on a control signal from the controller 40.

When the controller 40 outputs a control signal to drive the solenoid proportional valves 54*a*, 56*c*, and 56*d* in the control hydraulic unit 160 structured as described above, a pilot pressure (second control signal) is generated even if the associated operation devices 45*a*, 46*a* are not operated by the operator. This makes it possible to forcibly perform a boom raising operation, a bucket crowding operation, and a bucket dumping operation. Meanwhile, when the controller 40 similarly drives the solenoid proportional valves 54*b*, 55*a*, 55*b*, 56*a*, and 56*b*, the pilot pressure (second control signal) is generated. The second pressure (second control signal) is obtained by reducing the pilot pressure (first control signal) that is generated when the operation devices 45*a*, 45*b*, and 46*a* are operated by the operator. This makes it possible to forcibly reduce the speeds of a boom lowering operation, an arm crowding/dumping operation, and a bucket crowding/dumping operation to values lower than operator-inputted values.

In this document, a pilot pressure generated by operating the operation devices 45*a*, 45*b*, and 46*a*, which is among the control signals for the flow control valves 15*a* to 15*c*, is referred to as the "first control signal." A pilot pressure generated by allowing the controller 40 to drive the solenoid proportional valves 54*b*, 55*a*, 55*b*, 56*a*, and 56*b* in order to correct (reduce) the first control signal, and a pilot pressure generated newly and separately from the first control signal by allowing the controller 40 to drive the solenoid proportional valves 54*a*, 56*c*, and 56*d*, which are among the control signals for the flow control valves 15*a* to 15*c*, are referred to as the "second control signal."

The second control signal is generated when the velocity vector of the control point for the work device 1A, which is generated by the first control signal, does not meet predetermined conditions. The second control signal is generated as a control signal for generating a velocity vector of the control point for the work device 1A that meets the predetermined conditions. In a case where the first control signal is generated for one hydraulic drive section and the second control signal is generated for the other hydraulic drive section in the same flow control valve 15*a* to 15*c*, it is assumed that the second control signal preferentially works on a hydraulic drive section. Thus, the first control signal is blocked by a solenoid proportional valve, and the second control signal is inputted to the other hydraulic drive section. Consequently, a flow control valve 15*a* to 15*c* for which the second control signal is computed is controlled based on the second control signal, a flow control valve 15*a* to 15*c* for which the second control signal is not computed is controlled based on the first control signal, and a flow control valve 15*a* to 15*c* for which neither of the first and second control signals is generated is not controlled (not driven). When the first control signal and the second control signal are defined as described above, it can be said that MC is controlling the flow control valves 15*a* to 15*c* in accordance with the second control signal.

<Controller 40>

Referring to FIG. 4, the controller 40 includes an input section 91, a central processing unit (CPU) 92, which is a processor, a read-only memory (ROM) 93 and a random-access memory (RAM) 94, which are storage devices, and an output section 95. The input section 91 inputs signals from the angle sensors 30 to 32 and the angle sensor 33, which are included in the work device posture sensor 50, a signal from the target surface setting device 51, which sets the target surface 60, and a signal from the operator operation amount sensors 52*a*, which are the pressure sensors (including the pressure sensors 70, 71, and 72) for detecting the operation amounts from the operation devices 45*a*, 45*b*, and 46*a*, and then converts the inputted signals in such a manner that they can be computed by the CPU 92. The ROM 93 is a recording medium that stores, for example, a control program for executing MC including processes described in the later-described flowcharts, and various information necessary for executing the flowcharts. The CPU 92 performs predetermined computation processing on signals acquired from the input section 91 and the memories 93 and 94 in accordance with the control program stored in the ROM 93. The output section 95 creates an output signal based on the result of computation by the CPU 92, and outputs the created output signal to the solenoid proportional valves 54 to 56 or the display device 53, thereby driving and controlling the hydraulic actuators 5 to 7 and displaying images, for example, of the machine body 1B, bucket 10, and target surface 60 on a screen of the display device 53.

The controller 40 illustrated in FIG. 4 includes, as storage devices, the ROM 93 and the RAM 94, which are semiconductor memories. However, such semiconductor memories may be substituted by any storage device. For example, a hard disk drive or other magnetic storage device may be included as a substitute.

Figure 6:
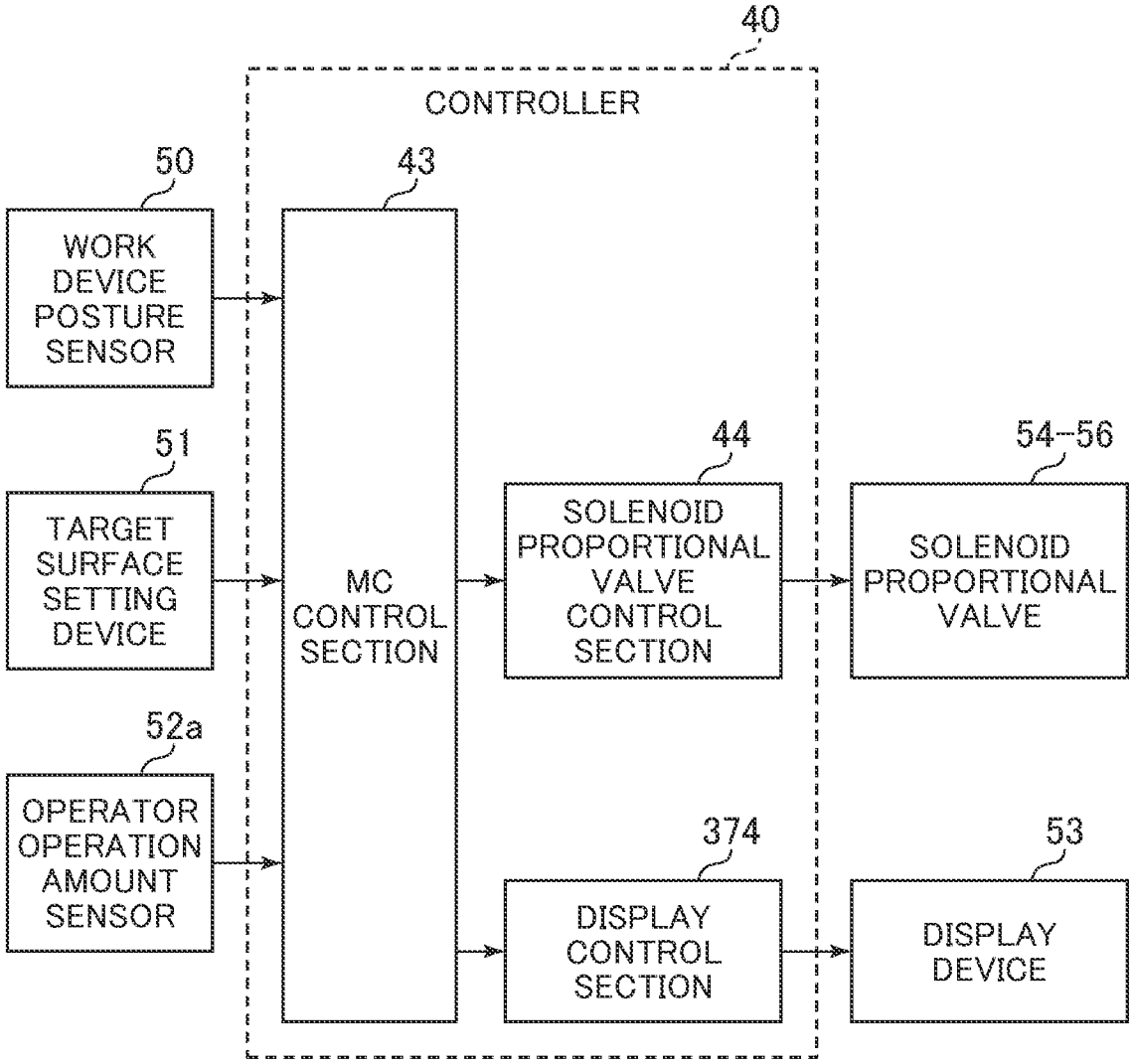
FIG. 6 is a functional block diagram illustrating the controller for the hydraulic excavator illustrated in FIG. 1.

FIG. 6 is a functional block diagram illustrating the controller 40. The controller 40 includes an MC control section 43, a solenoid proportional valve control section 44, and a display control section 374.

The display control section 374 controls the display device 53 in accordance with a work device posture and target surface outputted from the MC control section 43. The display control section 374 includes a display ROM that stores a large amount of display data including images and icons of the work device 1A. The display control section 374 reads a predetermined program based on a flag included in inputted information, and provides display control of the display device 53.

Figure 7:
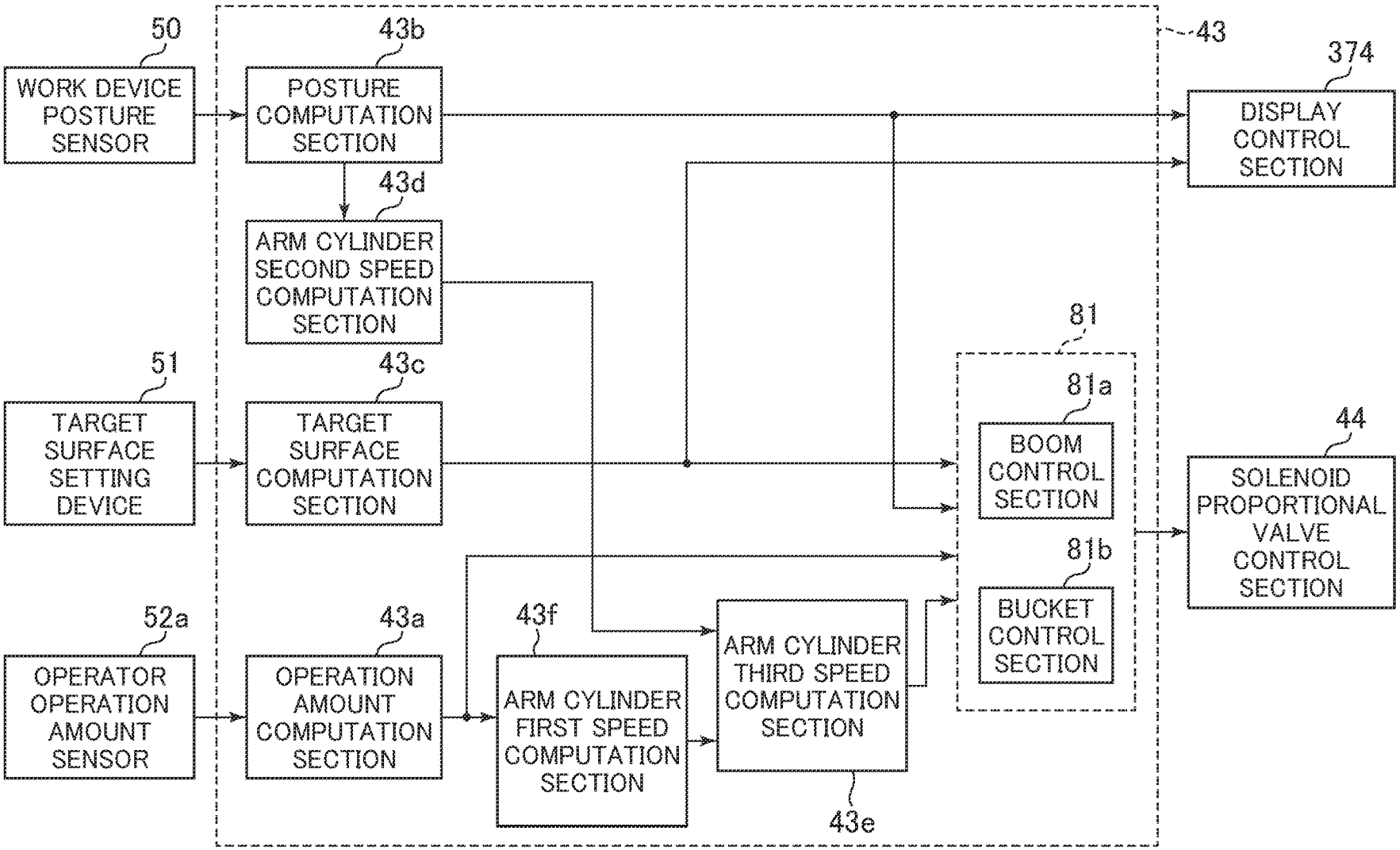
FIG. 7 is a functional block diagram illustrating an MC control section illustrated in FIG. 6.

FIG. 7 is a functional block diagram illustrating the MC control section 43 illustrated in FIG. 6. The MC control section 43 includes an operation amount computation section 43*a*, a posture computation section 43*b*, a target surface computation section 43*c*, an arm cylinder first speed computation section 43*f*, an arm cylinder second speed computation section 43*d*, an arm cylinder third speed computation section 43*e*, and an actuator control section 81 (a boom control section 81*a* and a bucket control section 81*b*).

The operation amount computation section 43*a* calculates the operation amounts of the operation devices 45*a*, 45*b*, and 46*a* (operation levers 1*a* and 1*b*) in accordance with values detected by the operator operation amount sensors 52*a*. That is to say, the operation amounts of the operation devices 45*a*, 45*b*, and 46*a* can be calculated from the values detected by the pressure sensors 70, 71, and 72.

Using the pressure sensors 70, 71, and 72 for operation amount calculation is merely an example. For example, a position sensor (e.g., rotary encoder) for detecting the rotational displacement of the operation levers for the operation devices 45*a*, 45*b*, and 46*a* may be used to detect the operation amounts of the operation levers.

The posture computation section 43*b* computes, in accordance with values detected by the work device posture sensor 50, the postures of the boom 8, arm 9, and bucket 10 in a local coordinate system, the posture of the front work device 1A, and the position of the claw tip of the bucket 10.

Figure 5:
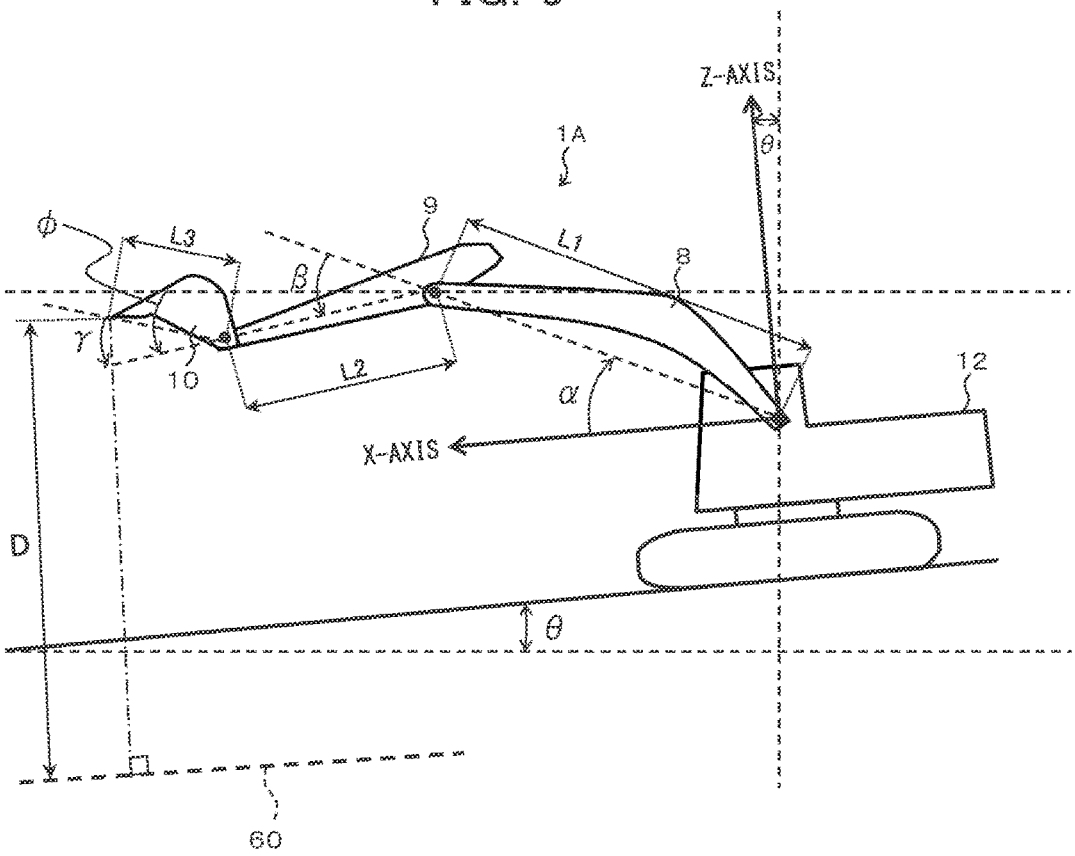
FIG. 5 is a diagram illustrating a coordinate system and target surface of the hydraulic excavator illustrated in FIG. 1.

The postures of the boom 8, arm 9, and bucket 10 and the posture of the front work device 1A can be defined in an excavator coordinate system (local coordinate system) illustrated in FIG. 5. The excavator coordinate system (XZ coordinate system) illustrated in FIG. 5 is a coordinate system set for the upper swing structure 12. The origin of this coordinate system is the base of the boom 8, which is pivotally supported by the upper swing structure 12. The Z-axis of this coordinate system is set in the vertical direction of the upper swing structure 12, and the X-axis is set in the horizontal direction of the upper swing structure 12. It is assumed that the inclination angle of the boom 8 with respect to the X-axis is the boom angle $\alpha$, and that the inclination angle of the arm 9 with respect to the boom 8 is the arm angle $\rho$, and further that the inclination angle of the bucket claw tip with respect to the arm is the bucket angle $\gamma$. It is also assumed that the inclination angle of the machine body 1B (upper swing structure 12) with respect to the horizontal plane (reference plane) is the inclination angle $\theta$. The boom angle $\alpha$ is detected by the boom angle sensor 30, the arm angle $\beta$ is detected by the arm angle sensor 31, the bucket angle $\gamma$ is detected by the bucket angle sensor 32, and the inclination angle $\theta$ is detected by the machine body inclination angle sensor 33. When the lengths of the boom 8, arm 9, and bucket 10 are L1, L2, and L3, respectively, as defined in FIG. 5, the coordinates of the position of the bucket claw tip in the excavator coordinate system, the postures of the boom 8, arm 9, and bucket 10, and the posture of the work device 1A can be expressed by L1, L2, L3, $\alpha$, $\beta$, and $\gamma$.

The target surface computation section 43*c* computes the position information about the target surface 60 in accordance with information from the target surface setting device 51, and stores the computed position information in the ROM 93. In the present embodiment, a cross-sectional shape obtained by cutting a three-dimensional target surface along a plane on which the work device 1A moves (the motion plane of the work device) as illustrated in FIG. 5 is used as the target surface 60 (two-dimensional target surface).

In the example of FIG. 5, there is one target surface 60. In some cases, however, a plurality of target surfaces may exist. In a case where a plurality of target surfaces exist, an available method, for example, is to use a target surface that is closest to the work device 1A, use a target surface that is positioned below the bucket claw tip, or use an arbitrarily selected target surface.

Figure 9:
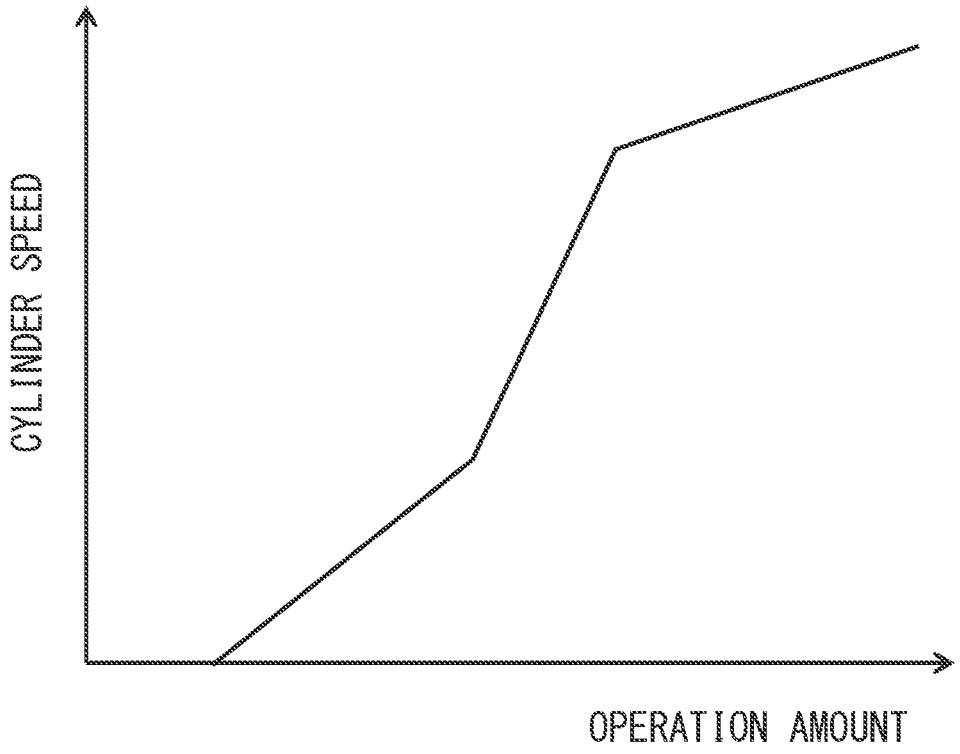
FIG. 9 is a diagram illustrating the relationship of a cylinder speed to an operation amount.

The arm cylinder first speed computation section 43*f* calculates the speed of the arm cylinder 6 from a detected operation amount value for the arm 9 that is among the values detected by the operator operation amount sensors 52*a*, and outputs the result of calculation to the arm cylinder third speed computation section 43*e*. In the present embodiment, the operation amount computation section 43*a* calculates an arm operation amount from arm operation amounts detected by the operator operation amount sensors 52*a*, and the arm cylinder first speed computation section 43*f* calculates the speed of the arm cylinder 6 in accordance with the arm operation amount calculated by the operation amount computation section 43*a* and with a table illustrated in FIG. 9 that defines the correlation between arm operation amount and arm cylinder speed on a one-to-one basis. Based on the relationship of cylinder speed to operation amount, which is predetermined by experiments and simulations, the table illustrated in FIG. 9 defines the correlation between operation amount and speed in such a manner that the arm cylinder speed monotonically increases with an increase in the arm operation amount.

In this document, the arm 9, which is one of the three front members 8, 9, and 10 forming the front work device 1A, is referred to as the "specific front member," and the arm cylinder 6, which drives the arm 9, is referred to as the "specific hydraulic actuator." The speed of the arm cylinder 6, which is calculated by the arm cylinder first speed computation section 43*f*, is referred to as the "first speed."

The arm cylinder second speed computation section 43*d* calculates the speed of the arm cylinder 6 from a detected posture value of the arm 9 that is among the values detected by the work device posture sensor 50, and outputs the result of calculation to the arm cylinder third speed computation section 43*e*. In the present embodiment, the posture computation section 43*b* calculates the posture of the arm 9 from values of the arm 9 that are detected by the work device posture sensor 50, and the arm cylinder second speed computation section 43*d* calculates the speed of the arm cylinder 6 from temporal changes in the posture of the arm 9, which are calculated by the posture computation section 43*b*, and dimension values (described later with reference to FIG. 5A) between positions to which the boom 8, the arm 9, and the arm cylinder 6 are respectively connected. In this document, the speed of the arm cylinder 6 that is calculated by the arm cylinder second speed computation section 43*d* is referred to as the "second speed."

Figure 5A:
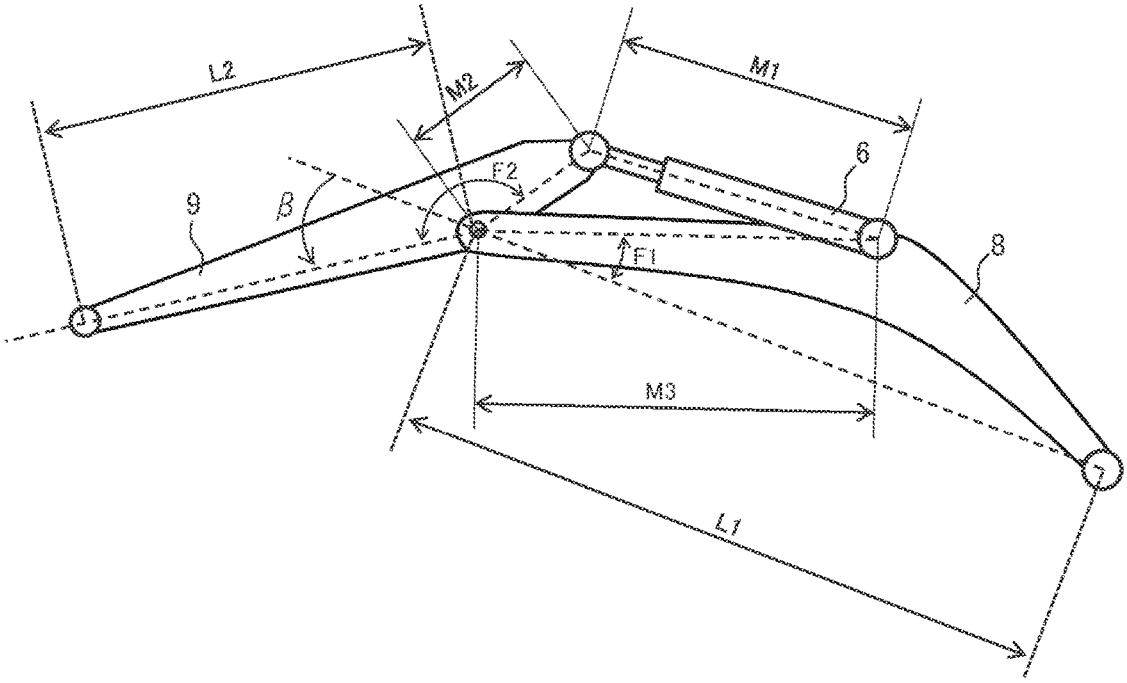
FIG. 5A is a diagram illustrating the dimension values of a front work device 1A that are used to calculate a second speed of an arm cylinder.

The dimension values of the front work device 1A that are used to calculate the second speed will now be described with reference to FIG. 5A. First of all, a line segment M2, a line segment M3, an angle F1, an angle F2, and the arm angle $\beta$ are used to determine an arm cylinder length M1 from the cosine formula concerning a triangle formed of line segments M1, M2, and M3. The line segment M2 joins a connection point between the boom 8 and the arm 9 to a connection point between the arm 9 and the arm cylinder 6. The line segment M3 joins a connection point between the boom 8 and the arm 9 to a connection point between the boom 8 and the arm cylinder 6. The angle F1 is formed by a line segment L1 and the line segment M3. The line segment L1 is the length of the boom 8. The angle F2 is formed by a line segment L2 and the line segment M2. The line segment L2 is the length of the arm 9. Further, the second speed of the arm cylinder 6 is calculated by calculating temporal changes in the determined arm cylinder length M1.

Based on the first speed of the arm cylinder 6, which is computed by the arm cylinder first speed computation section 43*f*, and on the second speed of the arm cylinder 6, which is computed by the arm cylinder second speed computation section 43*d*, the arm cylinder third speed computation section 43*e* calculates a speed (referred to as the "third speed") that is used as the speed of the arm cylinder 6 when the actuator control section 81 executes MC. The arm cylinder third speed computation section 43*e* then outputs the result of calculation to the actuator control section 81. The calculation of the third speed that is performed by the arm cylinder third speed computation section 43*e* will be described in detail later with reference to FIG. 11.

The boom control section 81*a* and the bucket control section 81*b* form the actuator control section 81, which controls at least one of a plurality of hydraulic actuators 5, 6, and 7 under predetermined conditions when the operation devices 45*a*, 45*b*, and 46*a* are operated. The actuator control section 81 computes target pilot pressures for the flow control valves 15*a*, 15*b*, and 15*c* of the hydraulic cylinders 5, 6, and 7, and outputs the computed target pilot pressures to the solenoid proportional valve control section 44.

When the operation devices 45*a*, 45*b*, and 46*a* are operated, based on the position of the target surface 60, the posture of the front work device 1A, the position of the claw tip of the bucket 10, and the speeds of the hydraulic cylinders 5, 6, and 7, the boom control section 81*a* executes MC in order to control the operation of the boom cylinder 5 (boom 8) in such a manner that the claw tip (control point) of the bucket 10 is positioned on or above the target surface 60. The boom control section 81*a* computes the target pilot pressure for the flow control valve 15*a* of the boom cylinder 5. MC executed by the boom control section 81*a* will be described in detail later with reference to FIG. 8.

The bucket control section 81*b* executes bucket angle control based on MC when the operation devices 45*a*, 45*b*, and 46*a*. More specifically, when the distance between the target surface 60 and the claw tip of the bucket 10 is not greater than a predetermined value, MC (bucket angle control) is executed to control the operation of the bucket cylinder 7 (bucket 10) in such a manner that the angle θ of the bucket 10 with respect to the target surface 60 coincides with a preset bucket angle with respect to target surface, which is designated as OTGT. The bucket control section 81*b* computes the target pilot pressure for the flow control valve 15*c* of the bucket cylinder 7.

Based on the target pilot pressures for the flow control valves 15*a*, 15*b*, and 15*c*, which are outputted from the actuator control section 81, the solenoid proportional valve control section 44 computes commands for the solenoid proportional valves 54 to 56. When a pilot pressure (first control signal) based on an operator operation coincides with a target pilot pressure calculated by the actuator control section 81, a current value (command value) for the associated solenoid proportional valve 54 to 56 is zero so that the associated solenoid proportional valve 54 to 56 does not operate.

<Third-Speed Calculation Flow of Arm Cylinder Third Speed Computation Section 43*e*>

Figure 11:
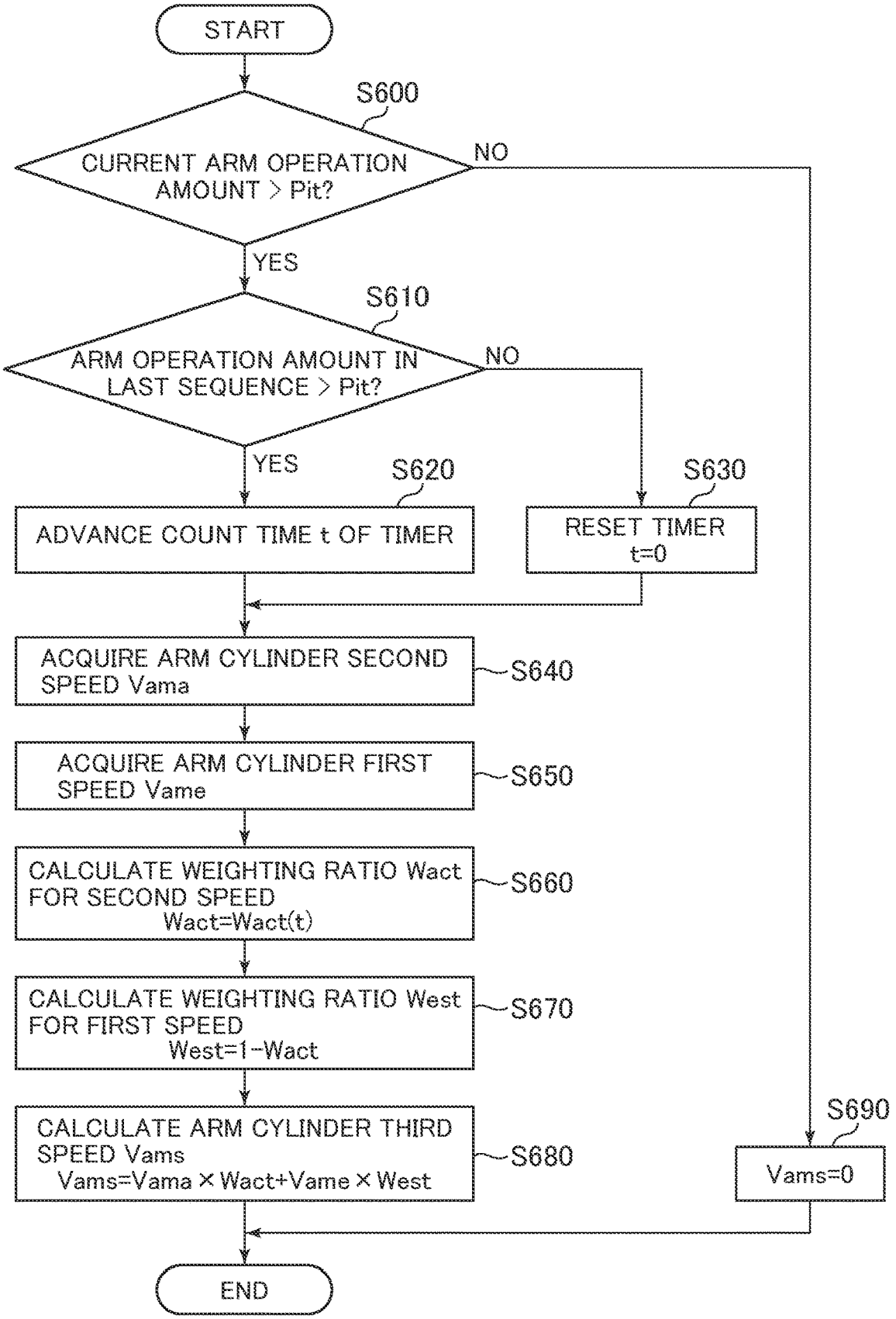
FIG. 11 is a flowchart illustrating the calculation of an expected arm cylinder speed.

FIG. 11 is a flowchart illustrating how the arm cylinder third speed computation section 43*e* calculates the third speed of the arm cylinder 6. The arm cylinder third speed computation section 43*e* repeatedly performs a procedure described in FIG. 11 at predetermined control intervals. In the following description, the control intervals are referred to also as the sequences. Operations described in FIG. 11 are performed by the arm cylinder third speed computation section 43*e*.

In step S600, a check is performed to determine whether a current arm operation amount computed by the operation amount computation section 43*a* is greater than a threshold value Pit. The threshold value Pit is a constant for determining whether the arm 9 is operated. If the arm operation amount is greater than the threshold value pit, it is determined that an arm operation is performed, and then processing proceeds to step S610. If, by contrast, the arm operation amount is not greater than the threshold value Pit, it is determined that no arm operation is performed, and then processing proceeds to step S690.

In step S610, a check is performed to determine whether the arm operation amount in the last sequence is greater than the threshold value Pit. If step S610 is answered YES, it is concluded that an arm operation is continuously performed beginning with the last sequence, and then processing proceeds to step S620. In step S620, the count time t of a timer is advanced by an amount equivalent to a control interval, and then processing proceeds to step S640. If, by contrast, step S610 is answered NO, it is concluded that the arm operation is started in the current sequence, the count time t of the timer is reset in step S630, that is, the count time t is assumed to be equal to 0, and then processing proceeds to step S640.

In step S640, the second speed Vama calculated by the arm cylinder second speed computation section 43*d* is acquired, and then processing proceeds to step S650.

In step S650, the first speed Vame calculated by the arm cylinder first speed computation section 43*f* is acquired, and then processing proceeds to step S660.

Figure 12:
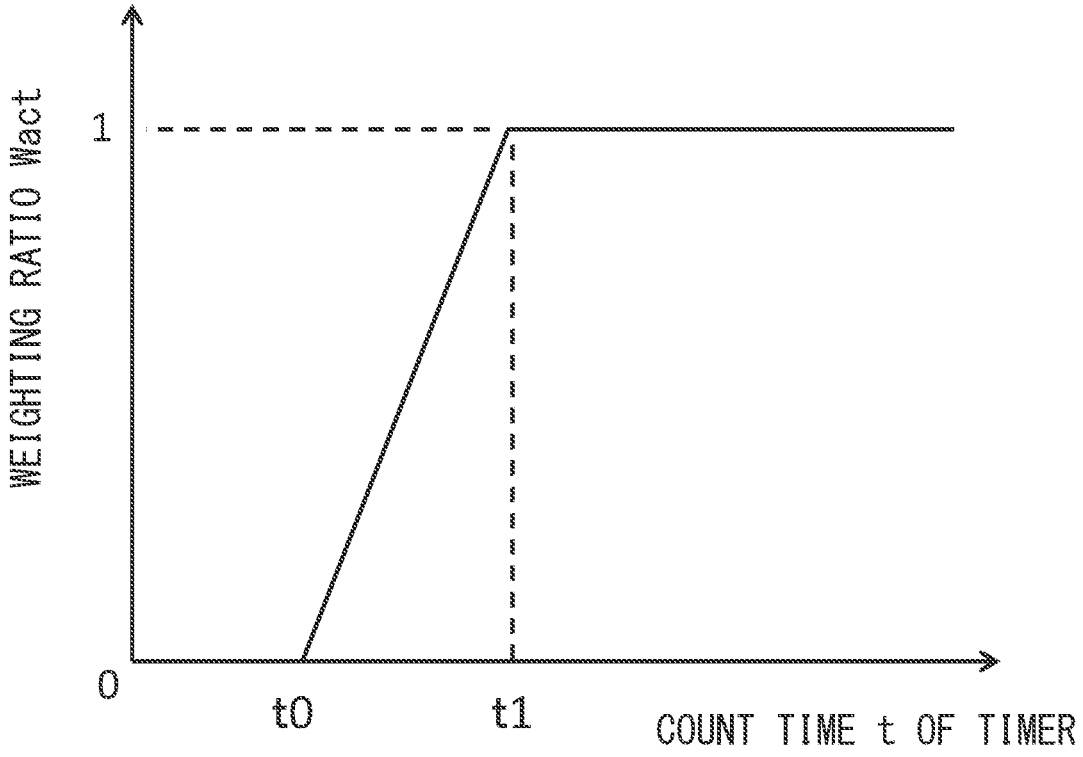
FIG. 12 is a diagram illustrating temporal changes in a weighting ratio Wact.

In step S660, a weighting ratio Wact for the second speed Vama is calculated from the count time t calculated in step S620 or S630 and a table illustrated in FIG. 12. The weighting ratio Wact is a function that is determined by the count time t of the timer as illustrated in FIG. 12. In this document, the weighting ratio Wact may be referred to as the "second weighting function." Referring to FIG. 12, Wact remains at 0 while t is 0 to t0, increases monotonically from 0 to 1 with an increase in the count time t while t is t0 to t1, and remains at 1 while t is t1 or greater.

Figure 17:
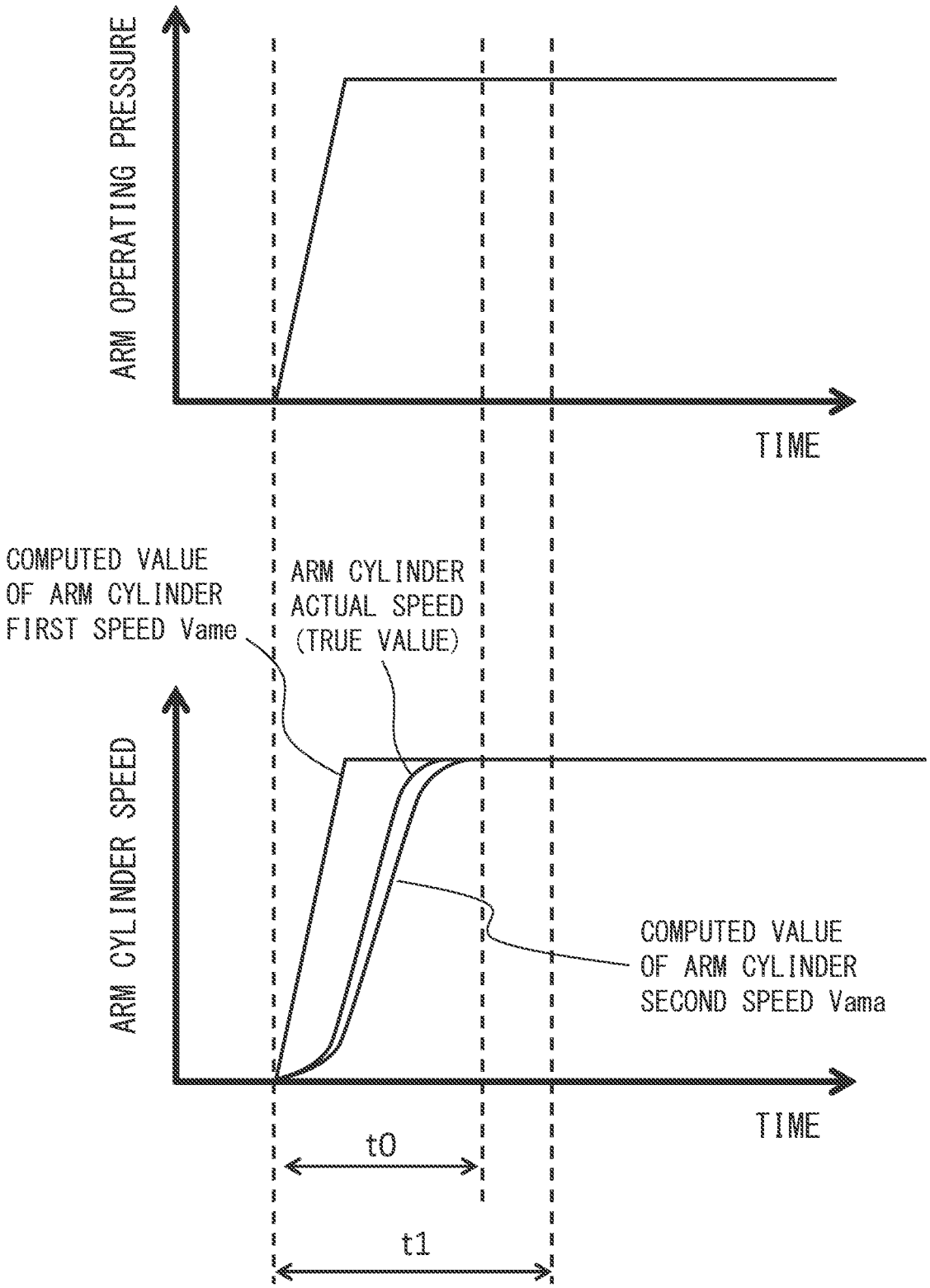
FIG. 17 is a diagram illustrating the relationship between an arm operating pressure and arm cylinder speeds (first speed, second speed, and actual speed).

In this document, time t0 and time t1 may be referred to respectively as the "first predetermined time" and the "second predetermined time." Time t0 and time t1 may be set, for example, as described below by selecting a value in consideration of a delay in the response from the work device posture sensor 50. FIG. 17 is a diagram schematically illustrating the relationship between examples of t0 and t1 and the first, second, and actual speeds of the arm cylinder 6. When an arm operating pressure is rapidly increased from zero as illustrated in the upper half of FIG. 17, the first speed, second speed, and actual speed (true value) of the arm cylinder 6 change as illustrated in the lower half of FIG. 17. That is to say, as the first speed is calculated from the arm operating pressure (operation amount) and the table illustrated in FIG. 9 as mentioned earlier, changes in the first speed occur at substantially the same timing as changes in the arm operating pressure. In reality, however, the arm cylinder 6 starts moving in delayed response to a lever operation by the operator. Therefore, the actual speed changes with a delay from the first speed as illustrated in FIG. 17. Further, as the second speed is calculated based on actual posture changes of the arm 9 as mentioned earlier, the second speed changes with a delay from the actual speed as illustrated in FIG. 17 and, at the end of time t0, eventually reaches a value identifiable as the same as the actual speed. In view of the above circumstances, the required time interval between the instant at which a lever operation is started and the instant at which the second speed coincides with the actual speed is set to t0 in the present embodiment. Further, t1, which is assumed to be greater than t0, is set as a sufficient time interval so that the operation of the bucket claw tip does not cause the operator to feel uncomfortable even if the third speed gradually changes from the first speed to the second speed during the transition from t0 to t1. Time t0 and time t1 can be set to a small value as far as the response of the boom (response of MC) can be properly obtained (time t0 and time t1 can be set, for example, to a value of 2 seconds or smaller).

In step S670, the weighting ratio West for the arm cylinder first speed Vame is calculated from the weighting ratio Wact for the arm cylinder second speed, which is calculated in step S660. In this document, the weighting ratio West may be referred to as the "first weighting function." The weighting ratio West is calculated from the equation West=1−Wact. That is to say, the weighting ratio West remains at 1 while t is 0 to t0, decreases monotonically from 1 to 0 with an increase in the count time t while t is t0 to t1, and remains at 0 while t is t1 or greater.

In step S680, an arm cylinder third speed Vams is outputted as Vams=Vams×Wact+Vame×West. More specifically, the sum of a value obtained by multiplying the first speed Vame by the first weighting function West and a value obtained by multiplying the second speed Vama by the second weighting function Wact is calculated as the third speed, and then the result of such computation is outputted to the actuator control section 81.

Meanwhile, if step S600 is answered NO, it is concluded that no arm operation is performed in step S600, and then in step S690, an arm cylinder third speed Vams of 0 is outputted.

<Flow of Boom Raising Control by Boom Control Section 81*a*>

Figure 8:
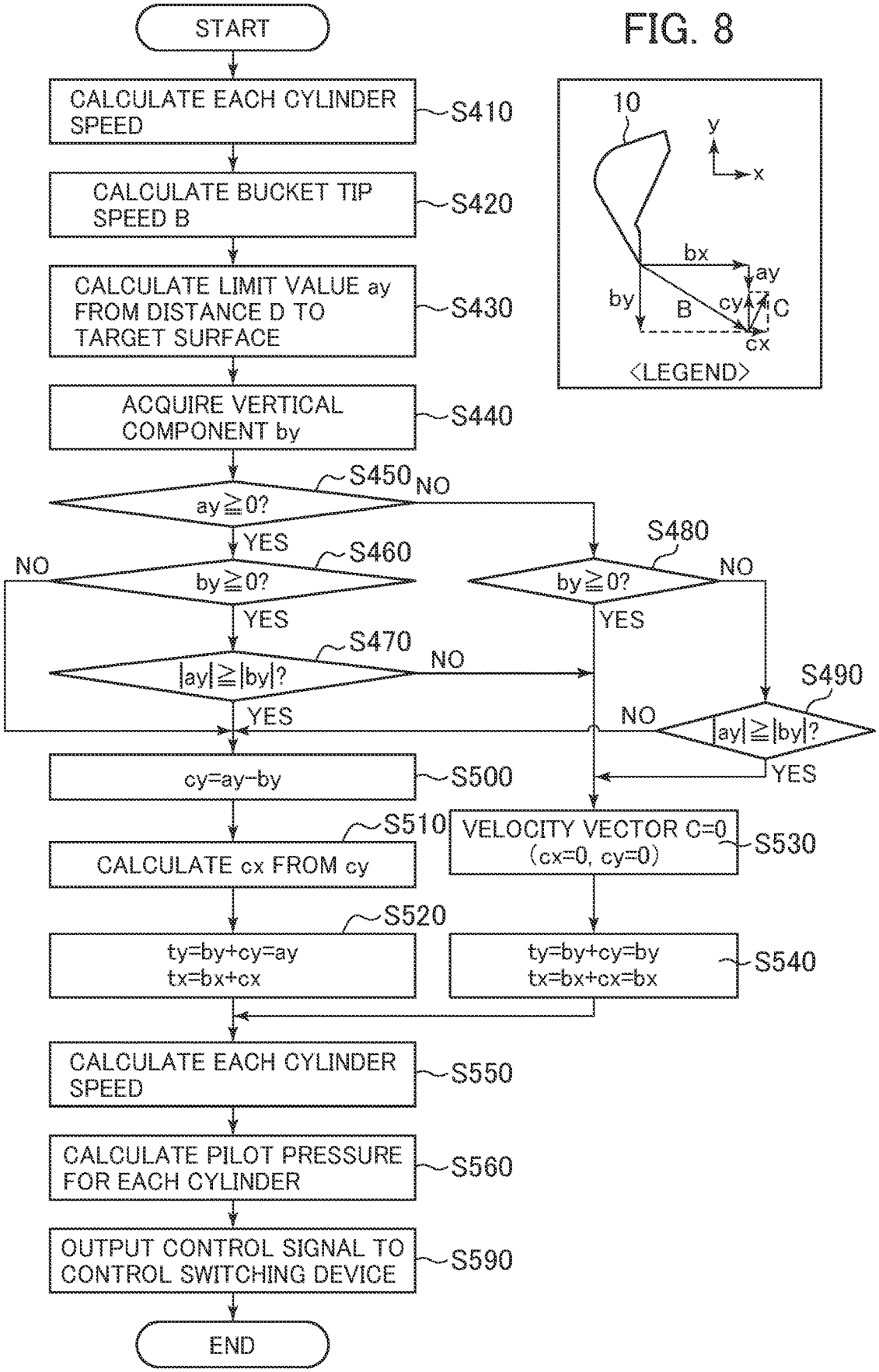
FIG. 8 is a flowchart illustrating boom raising control provided by a boom control section.

The controller 40 according to the present embodiment executes boom raising control by the boom control section 81*a* as MC. FIG. 8 is a flowchart illustrating boom raising control provided by the boom control section 81*a*. FIG. 8 is a flowchart illustrating how MC is executed by the boom control section 81*a*. Processing described in FIG. 8 starts when the operator operates the operation device 45*a*, 45*b*, 46*a*.

In step S410, the boom control section 81*a* acquires the speeds of the hydraulic cylinders 5, 6, and 7. The speeds of the boom cylinder 5 and bucket cylinder 7 are computed and acquired based on the amounts of operations performed for the boom 8 and the bucket 10, which are computed by the operation amount computation section 43*a*. More specifically, as is the case described earlier with reference to FIG. 9, the relationship of cylinder speed to operation amount, which is predetermined by experiments and simulations, is set as a table, and then the speeds of the boom cylinder 5 and bucket cylinder 7 are calculated in accordance with the table. Meanwhile, as regards the speed of the arm cylinder 6, the third speed Vams calculated by the arm cylinder third speed computation section 43*e* in accordance with the earlier described flowchart of FIG. 11 is acquired as the speed of the arm cylinder 6.

In step S420, based on the operating speeds of the hydraulic cylinders 5, 6, and 7, which are acquired in step S410, and on the posture of the work device 1A, which is computed by the posture computation section 43*b*, the boom control section 81*a* computes the velocity vector B of the tip (claw tip) of the bucket operated by the operator.

Figure 10:
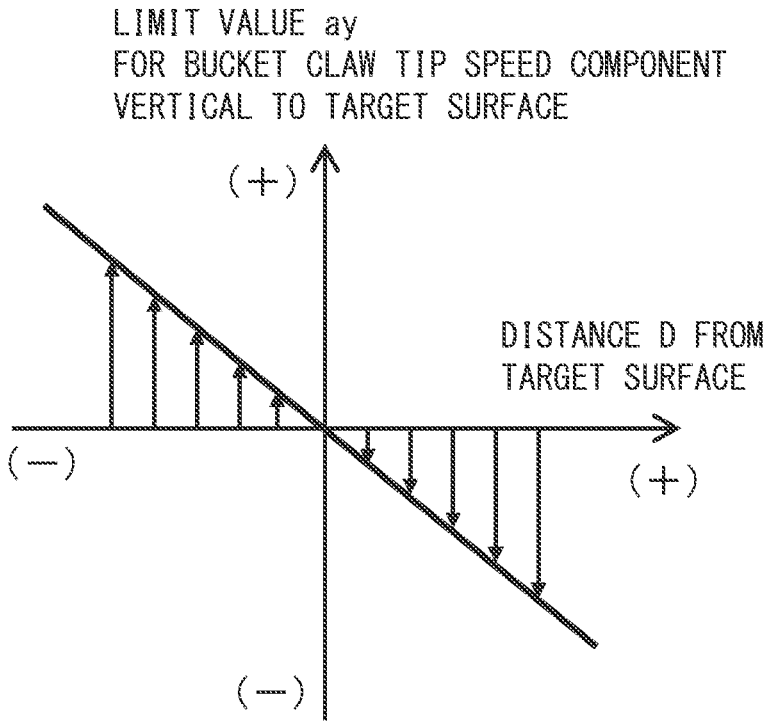
FIG. 10 is a diagram illustrating the relationship between a limit value ay for the vertical component of a bucket claw tip speed and a distance D.

In step S430, from the distance between the position (coordinates) of the claw tip of the bucket 10, which is computed by the posture computation section 43*b*, and a straight line including the target surface 60 stored in the ROM 93, the boom control section 81*a* calculates the distance D (see FIG. 5) from the tip of the bucket to the target surface 69 of a control target. Then, a limit value ay for the lower-limit side of a component of the velocity vector of the bucket tip that is vertical to the target surface 60 is calculated based on the distance D and the graph of FIG. 10.

In step S440, the boom control section 81*a* acquires a component by of the velocity vector B calculated in step S420 of the tip of the bucket operated by the operator that is vertical to the target surface 60.

In step S450, the boom control section 81*a* determines whether the limit value ay calculated in step S430 is 0 or greater. It should be noted that xy coordinates are set as illustrated in the upper right corner of FIG. 8. In the xy coordinates, it is assumed that the x-axis is parallel to the target surface 60 and positive in the rightward direction of FIG. 8, and that the y-axis is vertical to the target surface 60 and positive in the upward direction of FIG. 8. According to the legend in FIG. 8, the vertical component by and the limit value ay are negative, and a horizontal component bx, a horizontal component cx, and a vertical component cy are positive. Further, as is obvious from FIG. 10, when the limit value ay is 0, the distance D is 0, that is, the claw tip is positioned on the target surface 60, when the limit value ay is positive, the distance D is negative, that is, the claw tip is positioned below the target surface 60, and when the limit value ay is negative, the distance D is positive, that is, the claw tip is positioned above the target surface 60. If it is determined in step S450 that the limit value ay is 0 or greater (i.e., the claw tip is positioned on or below the target surface 60), processing proceeds to step S460. If, by contrast, the limit value ay is smaller than 0, processing proceeds to step S480.

In step S460, the boom control section 81*a* determines whether the vertical component by of the velocity vector B of the claw tip operated by the operator is 0 or greater. If the vertical component by is positive, it indicates that the vertical component by of the velocity vector B is oriented upward. If the vertical component by is negative, it indicates that the vertical component by of the velocity vector B is oriented downward. If it is determined in step S460 that the vertical component by is 0 or greater (i.e., the vertical component by is oriented upward), processing proceeds to step S470. If, by contrast, the vertical component by is smaller than 0, processing proceeds to step S500.

In step S470, the boom control section 81*a* compares the absolute value of the limit value ay with the absolute value of the vertical component by. If the absolute value of the limit value ay is equal to or greater than the absolute value of the vertical component by, processing proceeds to step S500. If, by contrast, the absolute value of the limit value ay is smaller than the absolute value of the vertical component by, processing proceeds to step S530.

In step S500, the boom control section 81*a* selects "cy=ay−by" as the equation for calculating the component cy vertical to the target surface 60 of a velocity vector C of the tip of the bucket that should be generated by the operation of the machine-controlled boom 8, and calculates the vertical component cy in accordance with the selected equation, the limit value ay in step S430, and the vertical component by in step S440. In step S510, the velocity vector C capable of outputting the calculated vertical component cy is calculated and its horizontal component is designated as cx.

In step S520, a target velocity vector T is calculated. When a component of the velocity vector T vertical to the target surface 60 is ty and a component of the velocity vector T horizontal to the target surface 60 is tx, the components are expressed by"ty=by+cy" and "tx=bx+cx," respectively. When the equation (cy=ay−by) in step S500 is substituted into the above equations, the target velocity vector T is eventually expressed by"ty=ay" and "tx=bx+cx." That is to say, when step S520 is reached, the vertical component ty of the target velocity vector is limited to the limit value ay, and a forced boom raising operation is initiated under machine control.

In step S480, the boom control section 81*a* determines whether the vertical component by of the velocity vector B of the claw tip operated by the operator is 0 or greater. If it is determined in step S480 that the vertical component by is 0 or greater (i.e., the vertical component by is oriented upward), processing proceeds to step S530. If, by contrast, the vertical component by is smaller than 0, processing proceeds to step S490.

In step S490, the boom control section 81*a* compares the absolute value of the limit value ay with the absolute value of the vertical component by. If the absolute value of the limit value ay is equal to or greater than the absolute value of the vertical component by, processing proceeds to step S530. If, by contrast, the absolute value of the limit value ay is smaller than the absolute value of the vertical component by, processing proceeds to step S500.

When step S530 is reached, the boom 8 need not be operated under machine control. Therefore, the boom control section 81*a* sets the velocity vector C to zero. In this instance, when based on the equations (ty=by+cy, tx=bx+cx) used in step S520, the target velocity vector T is expressed by "ty=by" and "tx=bx." As a result, the target velocity vector T coincides with the velocity vector B based on an operator operation (step S540).

In step S550, the boom control section 81*a* computes the target speeds of the hydraulic cylinders 5, 6, and 7 in accordance with the target velocity vector T (ty, tx) determined in step S520 or S540. As is obvious from the foregoing description, if the target velocity vector T does not coincide with the velocity vector B in the case of FIG. 8, the target velocity vector T is achieved by adding the velocity vector C, which is generated when the boom 8 is operated under machine control, to the velocity vector B.

In step S560, the boom control section 81*a* computes the target pilot pressures for the flow control valves 15*a*, 15*b*, and 15*c* of the hydraulic cylinders 5, 6, and 7 in accordance with the target speeds of the cylinders 5, 6, and 7, which are calculated in step S550.

In step S590, the boom control section 81*a* outputs the target pilot pressures for the flow control valves 15*a*, 15*b*, and 15*c* of the hydraulic cylinders 5, 6, and 7 to the solenoid proportional valve control section 44.

The solenoid proportional valve control section 44 controls the solenoid proportional valves 54, 55, and 56 in such a manner that the target pilot pressures are applied to the flow control valves 15*a*, 15*b*, and 15*c* of the hydraulic cylinders 5, 6, and 7. This causes the work device 1A to perform an excavation operation. When, for example, the operator operates the operation device 45*b* to perform an arm crowding operation for horizontal excavation, the solenoid proportional valve 55*c* is controlled so as to prevent the tip of the bucket 10 from intruding into the target surface 60 and automatically raise the boom 8.

In the present embodiment, boom control (forced boom raising control) by the boom control section 81*a* and bucket control (bucket angle control) by the bucket control section 81*b* are executed as MC. However, boom control based on the distance D between the bucket 10 and the target surface 60 may alternatively be executed as MC.

<Operations and Advantages>

Figure 13:
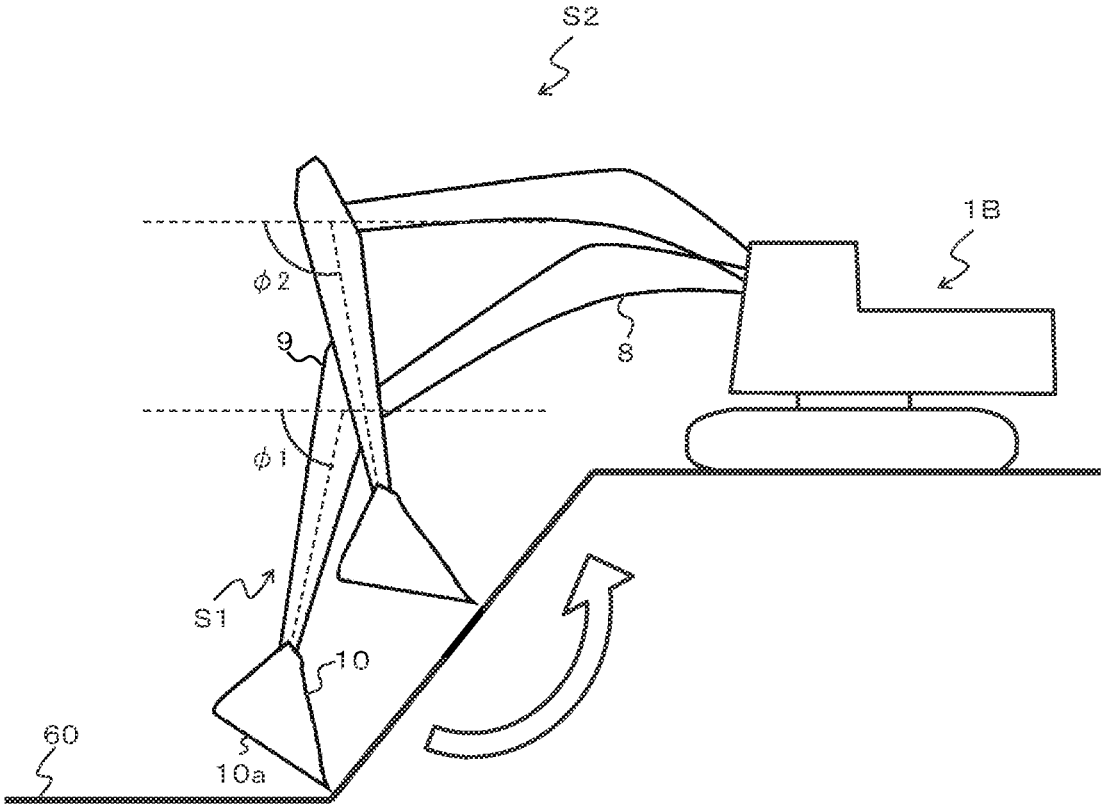
FIG. 13 is a diagram illustrating a raking-and-leveling operation.
Figure 14:
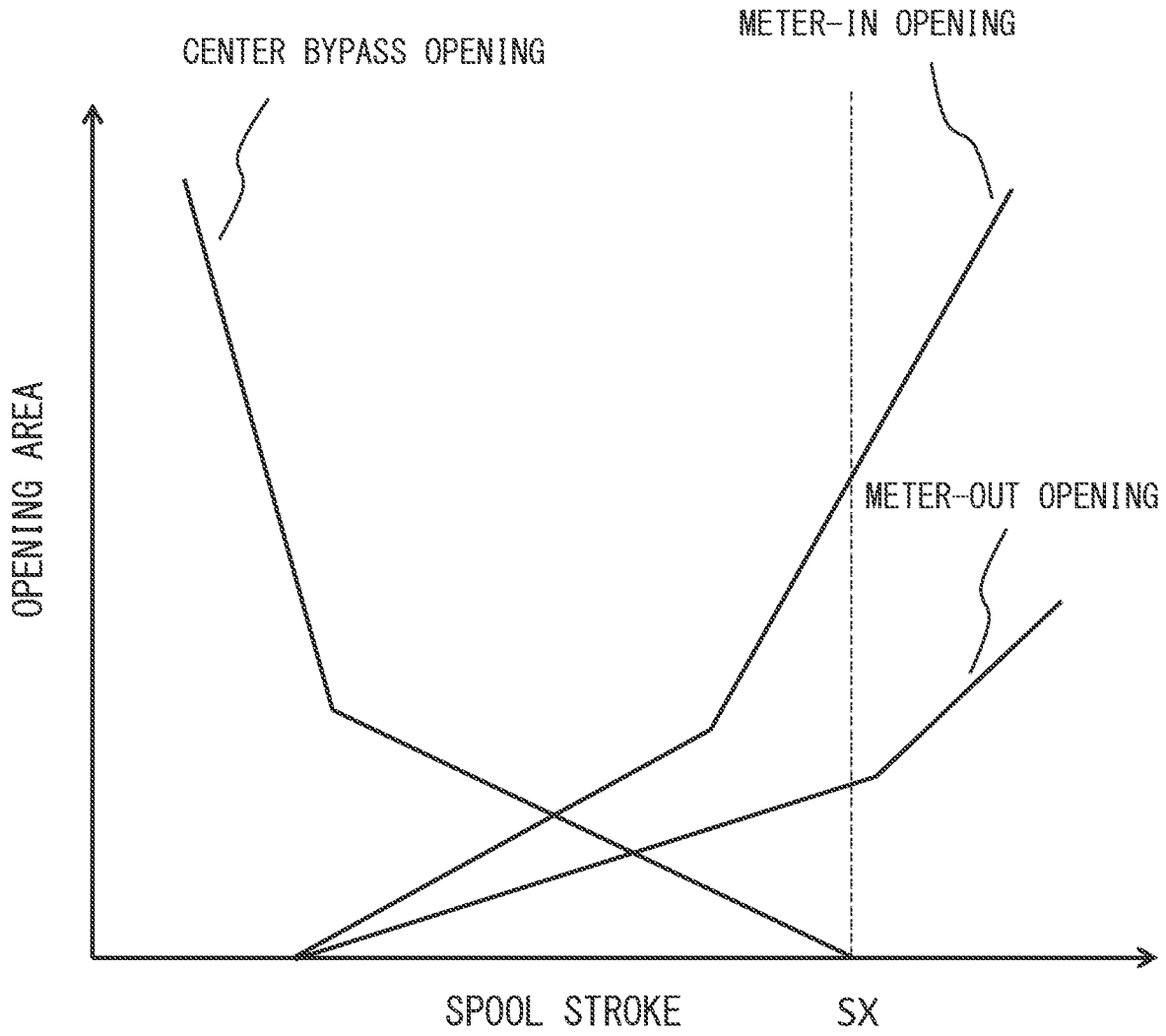
FIG. 14 is a diagram illustrating an opening area with respect to the spool stroke of a center bypass spool.

Operations of the hydraulic excavator structured as described above will now be described with reference to FIG. 13. The following describes an operation performed by the operator in order to transition from a state S1 to a state S2 as well as MC executed by the controller 40 (boom control section 81*a*) in a situation where the angle formed between the arm 9 and a horizontal plane passing through the pivoting center of the arm is an arm angle θ. The state S1 (FIG. 13, arm angle $\phi 1 \leq 90$ degrees) is a state where an arm crowding operation is inputted to start a raking-and-leveling operation. The state S2 (FIG. 13, arm angle $\phi 2 > 90$ degrees) is a state where the raking-and-leveling operation is in progress.

As time t0 and time t1 in FIG. 12 are minimum values (e.g., a value of 2 seconds or smaller) capable of properly obtaining the response of the boom (the response of MC), it is assumed that the transition from the state S1 to the state S2 after the start of an arm crowding operation occurs at time t1 or later. During the interval between the state S1 and state S2 in FIG. 13, the operator performs a crowding operation of the arm 9. If it is determined that the crowding operation of the arm 9 causes the bucket 10 to intrude into a position below the target surface 60, the boom control section 81*a* outputs a command to the solenoid valve 54*a* as illustrated in the flowchart of FIG. 8 in order to execute control (MC) for forcibly raising the boom 8.

(1) When the Elapsed Time from the Beginning of Arm Crowding is Shorter than t0

Firstly, when the elapsed time from the beginning of a crowding operation of the arm 9 by the operator is shorter than t0, the arm cylinder third speed computation section 43*e* outputs the first speed to the actuator control section 81 as the speed of the arm cylinder 6 in accordance with the control flowchart of FIG. 11. In this instance, the actuator control section 81 (boom control section 81*a*) calculates a bucket tip speed B while using the first speed as the speed of the arm cylinder 6, and MC is executed as needed in accordance with the flowchart of FIG. 8. As a result, the claw tip of the bucket 10 is held on or above the target surface 60. When MC is executed as described above by using the first speed as the speed of the arm cylinder 6 at the beginning of the operation of the arm 9, the response of boom raising control under MC is properly obtained although the first speed tends to be higher than an actual arm speed (see FIG. 17). Consequently, the behavior of the claw tip is stabilized.

(2) When the Elapsed Time from the Beginning of Arm Crowding is t0 or Longer but Shorter than t1

Secondly, when the elapsed time from the beginning of a crowding operation of the arm 9 by the operator is t0 or longer but shorter than t1, the arm cylinder third speed computation section 43*e* outputs the third speed Vams (yams=Vama×Wact+Vame×West), which is calculated from the first speed Vame, the second speed Vama, and the weighting ratios Wact, West, to the actuator control section 81 as the speed of the arm cylinder 6 in accordance with the control flowchart of FIG. 11. As a result, the speed used as the speed of the arm cylinder 6 by the actuator control section 81 (boom control section 81*a*) gradually shifts from the first speed to the second speed as time passes. This prevents a sudden change in the behavior of the bucket claw tip as compared with a case where a change from the first speed to the second speed suddenly occurs. Consequently, the operator does not feel uncomfortable with the behavior of the bucket claw tip.

(3) When the Elapsed Time from the Beginning of Arm Crowding is t1 or Longer Lastly, when the elapsed time from the beginning of a crowding operation of the arm 9 by the operator is t1 or longer, the arm cylinder third speed computation section 43*e* outputs the second speed to the actuator control section 81 as the speed of the arm cylinder 6 in accordance with the control flowchart of FIG. 11. In this instance, the actuator control section 81 (boom control section 81*a*) calculates the bucket tip speed B while using the second speed as the speed of the arm cylinder 6, and MC is executed as needed in accordance with the flowchart of FIG. 8. As a result, the claw tip of the bucket 10 is held on or above the target surface 60. When MC is executed as described above by using the second speed as the speed of the arm cylinder 6 during the operation of the arm 9, MC is executable at a speed close to an actual speed. Consequently, the behavior of the claw tip is stabilized.

Particularly, when MC is executed on or after time t1 while the arm angle ϕ is 90 degrees or smaller as in the state S2, the actual arm cylinder speed is lower than the first speed due to the own weights of front work devices (arm 9 and bucket 10) positioned forward of the arm 9. However, based on the flowchart of FIG. 11, the present embodiment executes MC by using the second speed calculated based on actual posture changes as the arm cylinder speed at and after time t1. As a result, a proper boom raising command is outputted to improve the accuracy of MC.

That is to say, as compared with a case where the first speed is constantly used as the arm cylinder speed during MC, the present embodiment uses the second speed calculated based on actual posture changes. Consequently, MC is stabilized as it is unlikely to be affected by changes, for example, in load pressure, posture, and hydraulic fluid temperature.

Embodiment 2

Embodiment 2 of the present invention will now be described.

First of all, a major problem to be solved by the present embodiment will be described. In Embodiment 1, a change in the posture of the arm cannot be detected by its posture sensor until the arm actually begins to move. Therefore, the response of MC may be delayed from the beginning of arm movement. However, if the operator suddenly changes the operation amount of the arm operation lever at a time point other than the beginning of arm movement, the actual arm cylinder speed may change earlier than the response of the posture sensor, as is the case with the beginning of arm movement. Consequently, the arm speed calculated from the output of the posture sensor may deviate from the actual arm speed, as is the case with the beginning of arm movement. Embodiment 2 is structured to solve such a problem.

Figure 15:
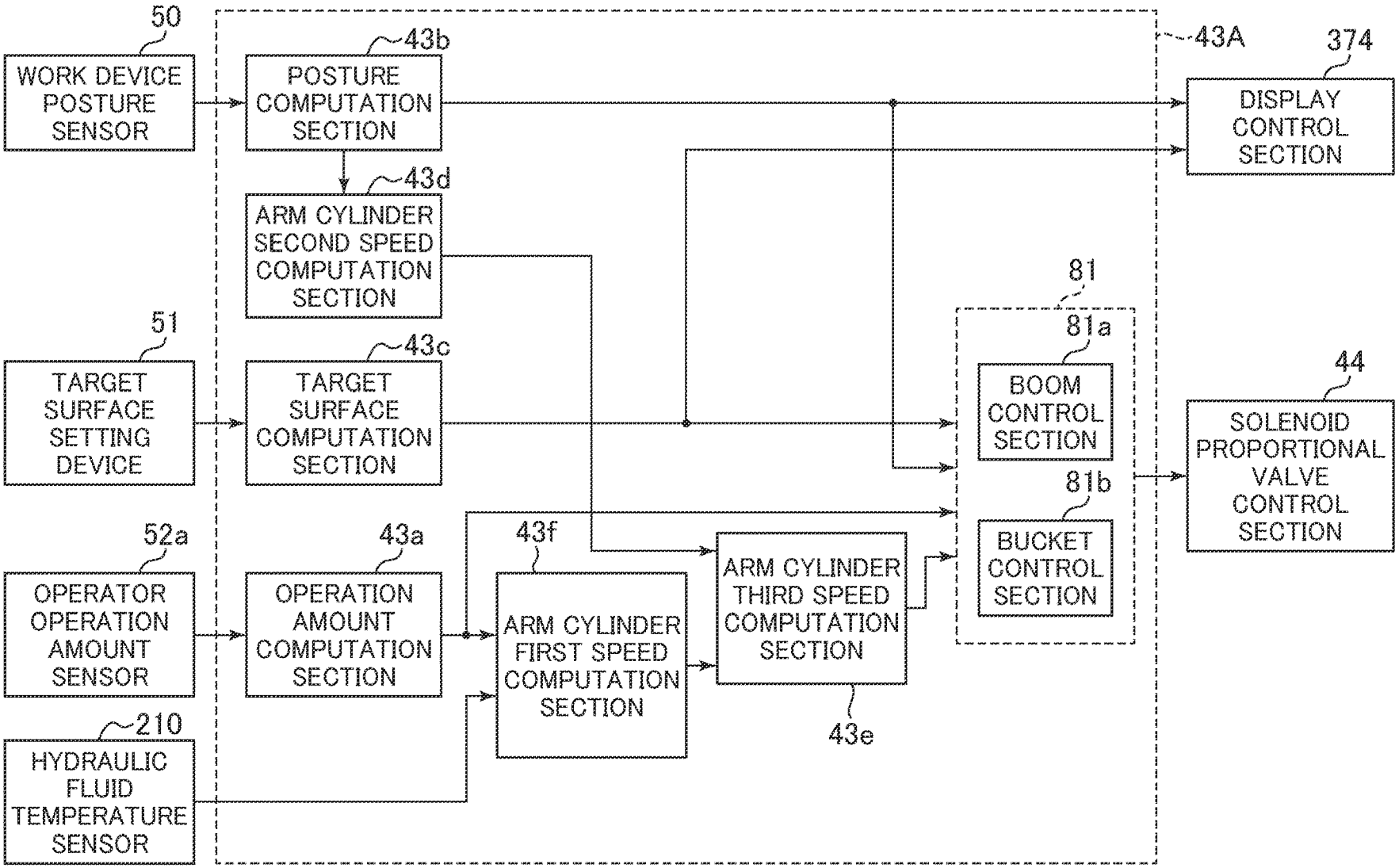
FIG. 15 is a functional block diagram illustrating the MC control section according to Embodiment 2.

FIG. 15 is a functional block diagram illustrating an MC control section 43A according to Embodiment 2. As illustrated in FIG. 15, the MC control section 43A according to the present embodiment differs from the MC control section according to Embodiment 1 in that a value detected by the hydraulic fluid temperature sensor 210 is inputted to the arm cylinder first speed computation section 43*f* and used to correct the first speed. Further, the present embodiment also differs from Embodiment 1 in the control flow of the arm cylinder third speed computation section 43*e*. The other elements of the present embodiment are the same as in Embodiment 1 and will not be redundantly described. The present embodiment is described in detail below.

<Flow of Third Speed Calculation by Arm Cylinder Third Speed Computation Section 43*e*>

Figure 16:
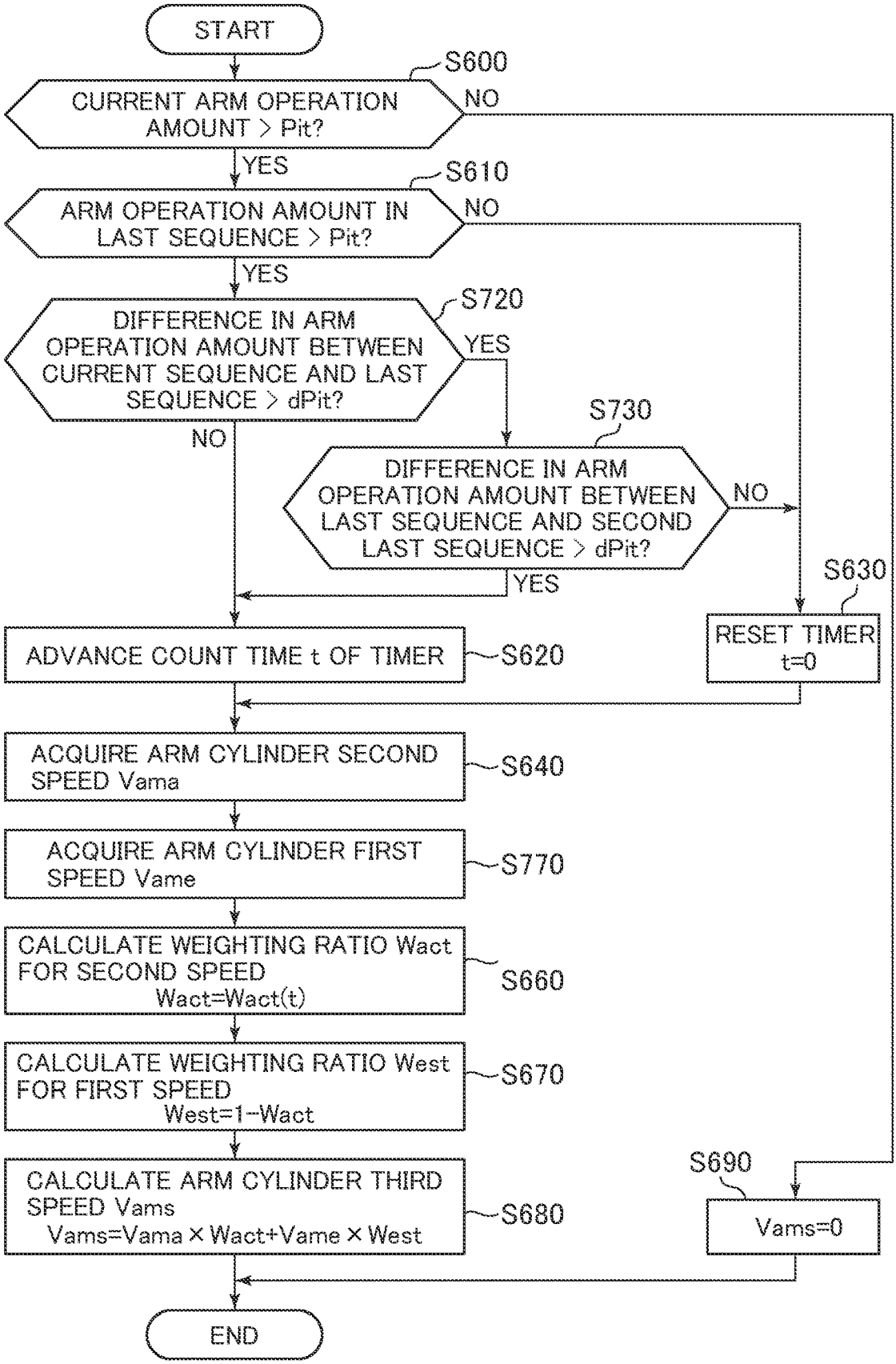
FIG. 16 is a flowchart illustrating the calculation of the expected arm cylinder speed according to Embodiment 2.

FIG. 16 is a flowchart illustrating how the arm cylinder third speed computation section 43*e* according to Embodiment 2 calculates the third speed of the arm cylinder 6. As is the case with Embodiment 1, the arm cylinder third speed computation section 43*e* repeatedly performs a procedure described in FIG. 16 at predetermined control intervals. Processing steps identical with those described in FIG. 11 are designated by the same reference numerals as those of the corresponding processing steps and will not be redundantly described. Operations described in FIG. 16 are performed by the arm cylinder third speed computation section 43*e*.

In step S720, a check is performed to determine whether the difference between a current arm operation amount computed by the operation amount computation section 43*a* and an arm operation amount computed in the last sequence is greater than a threshold value dPit. The threshold value dPit can be determined in a manner described below.

<Threshold Value dPit>

When the operating speed of the arm 9 is suddenly changed by an operator operation (when the amount of temporal change in the operating speed of the arm 9 is great), the second speed computed by the arm cylinder second speed computation section 43*d* may deviate from the actual arm cylinder speed (true value) depending on the detection response performance of the work device posture sensor 50. The amount of temporal change in the operating speed of the arm 9 that causes such deviation is assumed to be equal to or greater than a threshold value dWam. More specifically, the work device posture sensor 50 exhibits a delayed response if the amount of temporal change in the operating speed of the arm 9 is equal to or greater than the threshold value dWam, and responds without undue delay to the amount of change in the operating speed of the arm 9 if the amount of temporal change in the operating speed of the arm 9 is smaller than the threshold value dWam.

In the present embodiment, the amount of change in the arm operation amount (equivalent to the arm operating pressure) at which the amount of temporal change in the operating speed of the arm 9 is equal to the threshold value dWam is predetermined by experiments and simulations and set as the threshold value dPit.

If step S720 is answered YES (if the difference in the arm operation amount between the current sequence and the last sequence is greater than the threshold value dPit), it is concluded that the operating speed of the arm 9 is rapidly changed between the last sequence and the current sequence. Then, in step S730, a check is performed to determine whether the difference in the arm operation amount between the last sequence and the second last sequence is greater than the threshold value dPit.

If step S730 is answered YES (if the difference in the arm operation amount between the last sequence and the second last sequence is greater than the threshold value dPit), it is concluded that a state where the operating speed of the arm 9 is rapidly changed persists. Then, in step S620, the count time t of the timer is advanced by an amount equivalent to a control interval, and then processing proceeds to step S640.

If step S730 is answered NO (if the difference in the arm operation amount between the last sequence and the second last sequence is not greater than the threshold value dPit), it is concluded that a rapid change in the operating speed of the arm 9 is started in the current sequence. Then, in step S630, the count time t of the timer is reset, that is, set to 0, and then processing proceeds to step S640.

If step S720 is answered NO (if the difference in the arm operation amount between the current sequence and the last sequence is not greater than the threshold value dPit), it is concluded that the arm operation is continued from the last sequence (i.e., the encountered situation is the same as a situation where step S610 in Embodiment 1 is answered YES). Then, in step S620, the count time t of the timer is advanced by an amount equivalent to a control interval, and then processing proceeds to step S640.

In step S640, the second speed Vama calculated by the arm cylinder second speed computation section 43*d* is acquired, and then processing proceeds to step S770.

In step S770, the first speed Vame, which is calculated by the arm cylinder first speed computation section 43*f* in consideration of a value detected by the hydraulic fluid temperature sensor 210, is acquired.

<Correction Process for First Speed in Accordance with Hydraulic Fluid Temperature>

Figure 18:
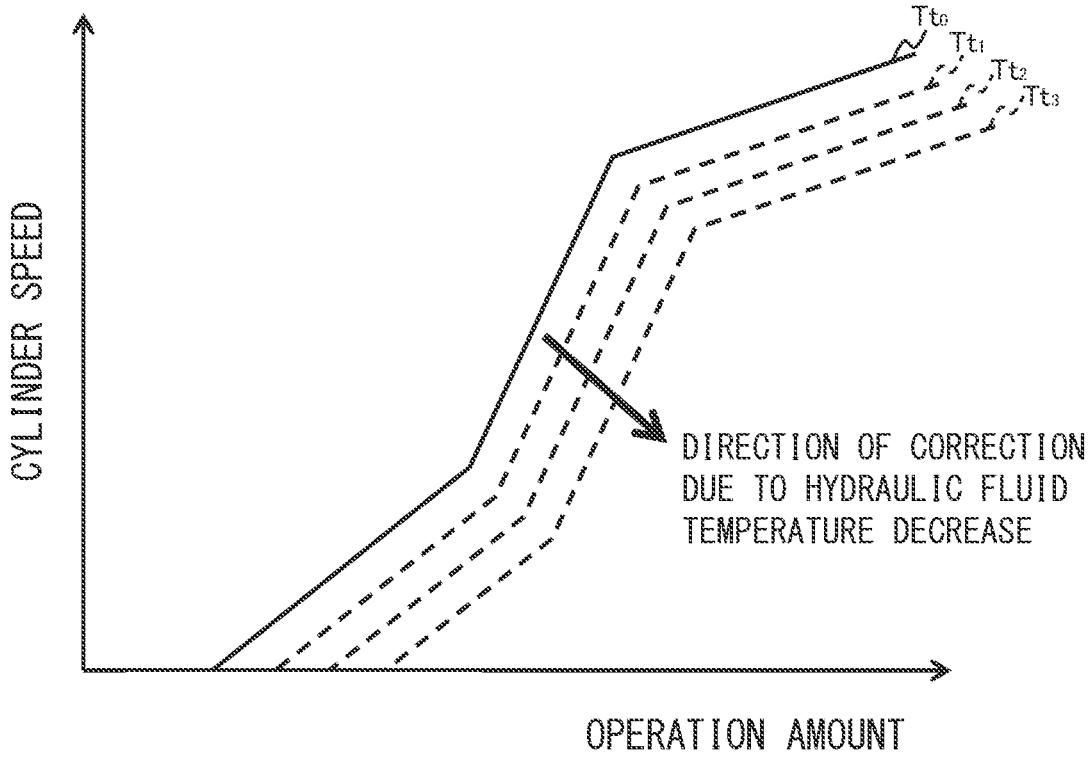
FIG. 18 is a diagram illustrating the relationship of the cylinder speed to the operation amount according to Embodiment 2.

A process performed by the arm cylinder first speed computation section 43*f* in order to compute the first speed in accordance with the present embodiment will now be described. The arm cylinder first speed computation section 43*f* calculates the first speed of the arm cylinder 6 in accordance with the arm operation amount calculated by the operation amount computation section 43*a*, with the table illustrated in FIG. 18 defining the correlation between arm operation amount and arm cylinder speed, and with a value (detected temperature Tt) detected by the hydraulic fluid temperature sensor 210. As is the case with the table illustrated in FIG. 9, the table illustrated in FIG. 18 defines the correlation between operation amount and speed so that the arm cylinder speed monotonically increases with an increase in the arm operation amount. When the temperature Tt detected by the hydraulic fluid temperature sensor 210 is equal to or lower than a predetermined value Tt0, the table illustrated in FIG. 18 is corrected so that the arm cylinder speed decreases with an increase in the deviation Alt between the temperature Tt detected by the hydraulic fluid temperature sensor 210 and the predetermined value Tt0. FIG. 18 indicates functions that are available when the temperature detected by the hydraulic fluid temperature sensor 210 is Tt0, Tt1, Tt2, and Tt3 (Tt3<Tt2<Tt1<Tt0). In consideration of the fact that the speed of the arm cylinder 6 decreases with an increase in the deviation Alt between the temperature Tt detected by the hydraulic fluid temperature sensor 210 and the predetermined value Tt0 as described above when the hydraulic fluid temperature Tt detected by the hydraulic fluid temperature sensor 210 is equal to or lower than the predetermined value Tt0, the arm cylinder first speed computation section 43*f* calculates, as the first speed Vame, a speed lower than the speed calculated from the table illustrated in FIG. 9 and the arm operation amount calculated by the operation amount computation section 43*a*.

Processing in steps S660 and beyond is the same as the processing illustrated in FIG. 11 and will not be redundantly described.

<Operations and Advantages>

If the operator using the hydraulic excavator structured as described above suddenly changes the arm operation amount during an arm operation, the arm cylinder third speed computation section 43*e* resets the timer in step S630 after performing steps S720 and S730 of FIG. 16, and outputs the first speed to the actuator control section 81 as the speed of the arm cylinder 6. The first speed then tends to be higher than the actual arm speed. However, the response of boom raising control under MC is properly obtained. Consequently, the behavior of the claw tip is stabilized.

If the amount of change in the lever operation amount is continuously greater than dPit, during the next control interval, the arm cylinder third speed computation section 43*e* advances the count time t of the timer by an amount equivalent to a control interval in step S620 after performing steps S720 and S730 of FIG. 16, and then processing proceeds to step S640. In steps S640 and beyond, the arm cylinder third speed computation section 43*e* outputs the third speed based on the count time t to the actuator control section 81.

If the count time t is t0 or longer but shorter than t1, in accordance with the control flowchart of FIG. 16, the arm cylinder third speed computation section 43*e* outputs the third speed Vams (yams=Vama×Wact+Vame×West), which is calculated from the first speed Vame, the second speed Vama, and the weighting ratios Wact, West, to the actuator control section 81 as the speed of the arm cylinder 6.

If the count time t is t1 or longer, in accordance with the control flowchart of FIG. 16, the arm cylinder third speed computation section 43*e* outputs the second speed to the actuator control section 81 as the speed of the arm cylinder 6. When MC is executed as described above by using the second speed as the speed of the arm cylinder 7 during an operation of the arm 9, MC is executable at a speed close to the actual speed. Consequently, the behavior of the claw tip is stabilized.

Further, even if the speeds of the hydraulic actuators are lowered due to a low hydraulic fluid temperature, an estimated speed of the arm cylinder is calculated based on the result of detection by the hydraulic fluid temperature sensor 210. As a result, the amount of boom raising operation is properly calculated.

Consequently, as compared with a case where the first speed is constantly used as the arm cylinder speed during MC, the present embodiment also uses the second speed calculated based on actual posture changes. As a result, MC is stabilized as it is unlikely to be affected by changes, for example, in load pressure, posture, and hydraulic fluid temperature.

<Other>

Embodiment 2, which has been described above, assumes that time t0 and time t1 are fixed values. Alternatively, however, the values of time t0 and time t1 may be variable with the amount of change in the arm operation amount.

In step S660 according to Embodiment 2, the weighting ratio Wact for the second speed Vama is calculated from the count time t of the timer and the table illustrated in FIG. 12, as is the case with Embodiment 1. Alternatively, however, the table to be used in a case where step S610 is answered NO (a case where an arm operation is determined to be started) may differ from the table to be used in a case where step S730 is answered NO (a case where the amount of change in the arm operation amount is determined to be equal to or greater than the threshold value dPit). More specifically, if step S730 is answered NO, a table different from the one illustrated in FIG. 12 may be used.

In Embodiment 2, the arm cylinder first speed computation section 43*f* performs a correction process for the first speed in accordance with the hydraulic fluid temperature. Alternatively, however, this correction process may be omitted from Embodiment 2 and may be added to Embodiment 1.

The foregoing embodiments use the angle sensors for detecting the angles of the boom 8, arm 9, and bucket 10. Alternatively, however, cylinder stroke sensors may be used instead of the angle sensors in order to calculate the posture information about an excavator. Further, the foregoing description deals with an example in which a hydraulic pilot operated excavator is used. However, when an electric lever operated excavator is used, it may be structured so as to control a command current generated from an electric lever. The velocity vector of the front work device 1A may be determined from an angular velocity that is calculated by differentiating the angles of the boom 8 and bucket 10 instead of being determined from an operator-operated pilot pressure.

In the foregoing embodiments, the process of calculating the arm cylinder speed is changed based on the elapsed time from the beginning of an arm operation or from the beginning of a sudden arm operation while the arm is regarded as the specific front member and the arm cylinder is regarded as the specific hydraulic actuator. However, the problem of the accuracy of speed calculation from an operation amount and the problem of response from a posture sensor also apply to a front member other than the arm, namely, the boom and the bucket. Consequently, the specific front member and the specific hydraulic actuator may be changed to the boom 8 and the boom cylinder 5 or to the bucket 10 and the bucket cylinder 7.

For example, elements pertaining to the controller 40 and their functions and processes to be executed may be partly or wholly implemented by hardware (e.g., by designing the logic for executing the functions with an integrated circuit). Further, the elements pertaining to the controller 40 may be implemented by a program (software) that exercises the functions of the elements of the controller 40 when read and executed by a computation processing unit (e.g., a CPU). Information pertaining to the program may be stored, for example, in a semiconductor memory (a flash memory, an SSD, etc.), a magnetic storage device (a hard disk drive, etc.), and a recording medium (a magnetic disk, an optical disk, etc.).

The present invention is not limited to the foregoing embodiments, but includes various modifications without departing from the spirit and scope thereof. For example, the present invention is not limited to a structure that includes all the elements described in conjunction with the foregoing embodiments, but is also applicable to a structure from which some of the elements are eliminated. Further, some of the elements in a certain embodiment may be added to the elements in another embodiment or used as their substitutes.

DESCRIPTION OF REFERENCE CHARACTERS

1A: Front work device
8: Boom
9: Arm
10: Bucket
30: Boom angle sensor
31: Arm angle sensor
32: Bucket angle sensor
40: Controller (controller)
43: MC control section
43*a*: Operation amount computation section
43*b*: Posture computation section
43*c*: Target surface computation section
43*d*: Arm cylinder second speed computation section
43*e*: Arm cylinder third speed computation section
43*f*: Arm cylinder first speed computation section
44: Solenoid proportional valve control section
45: Operation device (boom, arm)
46: Operation device (bucket, swing)
50: Work device posture sensor (posture sensor)
51: Target surface setting device
52*a*: Operator operation amount sensor (operation amount sensor)
53: Display device
54, 55, 56: Solenoid proportional valve
81: Actuator control section
81*a*: Boom control section
81*b*: Bucket control section
210: Hydraulic fluid temperature sensor

The invention claimed is:

1. A work machine having a work device, a plurality of hydraulic actuators, an operation device, and a controller, the work device including a plurality of front members, the plurality of hydraulic actuators driving the plurality of front members, the operation device instructing each of the plurality of hydraulic actuators on an operation thereof in accordance with an operation of an operator, the controller including an actuator control section that controls at least one of the plurality of hydraulic actuators in accordance with speeds of the plurality of hydraulic actuators and with predetermined conditions when the operation device is operated, the work machine comprising:

a posture sensor that detects a physical quantity concerning a posture of a specific front member that is one of the plurality of front members; and an operation amount sensor that detects a physical quantity concerning an operation amount for the specific front member that is among operation amounts inputted to the operation device by the operator, wherein:

the controller includes a first speed computation section that calculates, from a value detected by the operation amount sensor, a first speed of a specific hydraulic actuator for driving the specific front member among the plurality of hydraulic actuators, a second speed computation section that calculates a second speed of the specific hydraulic actuator from a value detected by the posture sensor, and a third speed computation section that calculates, in accordance with the first speed and with the second speed, a third speed that is used as a speed of the specific hydraulic actuator by the actuator control section; and the third speed computation section calculates the first speed as the third speed during a period between a detection of an input of operation for the specific front member by the operation amount sensor and a first predetermined time, calculates as the third speed a speed calculated from the first speed and the second speed during a period between the first predetermined time and a second predetermined time that is later than the first predetermined time, and calculates the second speed as the third speed at and after the second predetermined time.

2. The work machine according to claim 1, wherein the third speed computation section calculates, as the third speed, a sum of a value obtained by multiplying the first speed by a first weighting function and a value obtained by multiplying the second speed by a second weighting function, the first weighting function decreasing with an increase in the period of time between the first predetermined time and the second predetermined time, the second weighting function increasing with an increase in the period of time between the first predetermined time and the second predetermined time.

3. The work machine according to claim 1, wherein the third speed computation section calculates the first speed as the third speed during a period between an instant at which the operation amount sensor detects that the amount of change in the operation amount for the specific front member is equal to or greater than a predetermined amount and a third predetermined time, calculates a speed calculated from the first speed and the second speed as the third speed during a period between the third predetermined time and a fourth predetermined time, the fourth predetermined time being later than the third predetermined time, and calculates the second speed as the third speed at and after the fourth predetermined time.

4. The work machine according to claim 1, further comprising a hydraulic fluid temperature sensor that detects a hydraulic fluid temperature for driving the specific hydraulic actuator, wherein when the hydraulic fluid temperature detected by the hydraulic fluid temperature sensor is equal to or lower than a predetermined value, the first speed computation section calculates as the first speed a speed lower than a speed calculated from a value detected by the operation amount sensor.

5. The work machine according to claim 1, wherein the specific front member is an arm, and the specific hydraulic actuator is an arm cylinder for driving the arm.

* * * * *